US011039964B2

(12) United States Patent
Paul et al.

(10) Patent No.: US 11,039,964 B2
(45) Date of Patent: Jun. 22, 2021

(54) SYSTEMS AND METHODS FOR FACILITATING MOVEMENT OF A PATIENT TRANSPORT APPARATUS

(71) Applicant: Stryker Corporation, Kalamazoo, MI (US)

(72) Inventors: Anish Paul, Portage, MI (US); William D. Childs, Plainwell, MI (US); Kevin M. Patmore, Plainwell, MI (US)

(73) Assignee: Stryker Corporation, Kalamazoo, MI (US)

( * ) Notice: Subject to any disclaimer, the term of this patent is extended or adjusted under 35 U.S.C. 154(b) by 529 days.

(21) Appl. No.: 15/910,502

(22) Filed: Mar. 2, 2018

(65) Prior Publication Data

US 2018/0250178 A1 Sep. 6, 2018

Related U.S. Application Data

(60) Provisional application No. 62/467,499, filed on Mar. 6, 2017.

(51) Int. Cl.

| | |
|---|---|
| ***A61G 1/02*** | (2006.01) |
| ***A61G 7/05*** | (2006.01) |
| ***A61G 7/08*** | (2006.01) |

(52) U.S. Cl.

CPC ..... *A61G 1/0275* (2013.01); *A61G 1/0225* (2013.01); *A61G 1/0237* (2013.01);

(Continued)

(58) Field of Classification Search

CPC ..... A61G 7/0528; A61G 7/08; A61G 1/0287; A61G 1/0275; A61G 1/0281;

(Continued)

(56) References Cited

U.S. PATENT DOCUMENTS 4,715,460 A * 12/1987 Smith ..... A61G 5/046 180/210
5,213,176 A * 5/1993 Oroku ..... B60B 19/003 180/168

(Continued)

FOREIGN PATENT DOCUMENTS

AU 2008101281 A4 4/2011
CN 204814540 U 12/2015

(Continued)

OTHER PUBLICATIONS

English language abstract and machine-assisted English translation for JP 2007-283806 extracted from espacenet.com database on Nov. 7, 2019, 8 pages.

(Continued)

*Primary Examiner* — Steve Clemmons
(74) *Attorney, Agent, or Firm* — Howard & Howard Attorneys PLLC

(57) ABSTRACT

Systems and methods for facilitating movement of a patient transport apparatus. The patient transport apparatus has a support structure comprising a patient support surface. A wheel assembly comprises a base wheel having an outer periphery rotatably coupled to the support structure about a base rotational axis. The wheel assembly also comprises a plurality of peripheral wheels disposed about the outer periphery to rotate about a plurality of peripheral rotational axes. The wheel assembly comprises a motion control device configured to selectively control rotation of the peripheral wheels independent of rotation of the base wheel about the base rotational axis.

23 Claims, 30 Drawing Sheets

(52) U.S. Cl.
CPC ..... *A61G 1/0281* (2013.01); *A61G 1/0287* (2013.01); *A61G 7/0528* (2016.11); *A61G 7/08* (2013.01)

(58) Field of Classification Search
CPC .. A61G 1/0237; A61G 1/0225; B60B 19/003; B60B 19/125; B60K 7/0007; B62B 5/0033; B62B 5/004; B62B 5/04; B62B 5/048; B62B 2005/0471; B62B 2301/25; B62B 2301/254; B62B 2301/04; B62B 2301/02
See application file for complete search history.

(56) References Cited

U.S. PATENT DOCUMENTS

| | | | | |
|---|---|---|---|---|
| 6,330,926 | B1 | 12/2001 | Heimbrock et al. | |
| 7,441,786 | B2 | 10/2008 | Stryker et al. | |
| 7,636,966 | B2 | 12/2009 | Gallant et al. | |
| 7,735,165 | B2 | 6/2010 | Stryker et al. | |
| 7,938,756 | B2 | 5/2011 | Rodetsky et al. | |
| 8,196,944 | B1 | 6/2012 | Vondrak | |
| 8,424,621 | B2 * | 4/2013 | Uehara | B60B 19/003 180/7.1 |
| 8,499,864 | B2 * | 8/2013 | Takenaka | B60B 19/003 180/10 |
| 8,706,332 | B2 * | 4/2014 | Kume | A61G 5/04 701/22 |
| 8,758,191 | B2 * | 6/2014 | Takenaka | B60B 19/003 280/7.1 |
| 8,938,328 | B2 * | 1/2015 | Kume | B60L 58/12 701/22 |
| 9,554,953 | B2 * | 1/2017 | Dirauf | A61G 1/04 |
| 9,839,567 | B2 | 12/2017 | Hacikadiroglu et al. | |
| 9,937,943 | B2 * | 4/2018 | Nilsson | B62B 5/0026 |
| 10,555,849 | B2 * | 2/2020 | Zhang | A61G 7/015 |
| 2003/0115672 | A1 | 6/2003 | Newkirk | |
| 2006/0085913 | A1 | 4/2006 | Kawakami et al. | |
| 2006/0197299 | A1 | 9/2006 | Stryker et al. | |
| 2008/0018167 | A1 * | 1/2008 | Fuji | B60B 19/003 301/5.23 |
| 2008/0202837 | A1 * | 8/2008 | Macedo Ribeiro | A61G 5/046 180/236 |
| 2010/0038960 | A1 * | 2/2010 | Takenaka | B62K 1/00 305/133 |
| 2010/0096905 | A1 * | 4/2010 | Takenaka | B60B 19/00 301/5.23 |
| 2014/0076644 | A1 | 3/2014 | Derenne et al. | |
| 2014/0379130 | A1 * | 12/2014 | Lee | B62D 1/02 700/259 |
| 2015/0051519 | A1 * | 2/2015 | Morbi | A61G 7/1059 601/26 |
| 2015/0190293 | A1 | 7/2015 | Hacikadiroglu et al. | |
| 2016/0089283 | A1 | 3/2016 | DeLuca et al. | |
| 2016/0137216 | A1 | 5/2016 | Nilsson et al. | |
| 2016/0302986 | A1 * | 10/2016 | Haladova | A61G 5/006 |
| 2018/0297396 | A1 * | 10/2018 | Dietrich | A61G 7/05 |
| 2018/0361784 | A1 * | 12/2018 | Zapf | B60B 19/125 |

FOREIGN PATENT DOCUMENTS

| | | | |
|---|---|---|---|
| DE | 102011006359 | A1 | 10/2012 |
| EP | 2481388 | B1 | 11/2015 |
| JP | 2007283806 | A | 11/2007 |
| JP | 2009173068 | A | 8/2009 |
| JP | 4523244 | B2 | 8/2010 |
| WO | 2012055407 | A1 | 5/2012 |
| WO | 2014187864 | A1 | 11/2014 |

OTHER PUBLICATIONS

English language abstract and machine-assisted English translation for JP 2009-173068 extracted from espacenet.com database on Nov. 7, 2019, 8 pages.
English language abstract and machine-assisted English translation for JP 4523244 extracted from espacenet.com database on Nov. 7, 2019, 10 pages.
English language abstract and machine-assisted English translation for CN 204814540 extracted from espacenet.com database on May 21, 2018, 10 pages.
Machine-assisted English language abstract for DE102011006359 extracted from espacenet.com database on May 21, 2018, 3 pages.
"Screenshot of Sidewinder Forklifts", 2016, 1 page.
Wada, M., "Abstract of Holonomic and Omnidirectional Vehicle with Conventional Tires", Robotics and Automation, IEEE International Conference, vol. 4, 1996, 1 page.
Whill, "Whill Webpage-Intelligent Personal EVs—The Future of Power Wheelchairs", www.whill.us, 2016, 7 pages.

* cited by examiner

SYSTEMS AND METHODS FOR FACILITATING MOVEMENT OF A PATIENT TRANSPORT APPARATUS

RELATED APPLICATIONS

This application claims the benefit of and priority to U.S. Provisional Patent Application No. 62/467,499, filed on Mar. 6, 2017, the entire contents and disclosure of which are hereby incorporated herein by reference.

BACKGROUND

Patient transport apparatuses such as hospital beds, stretchers, cots, wheelchairs, and chairs are routinely used by operators to move patients from one location to another. A conventional patient transport apparatus comprises a base and a patient support surface upon which the patient is supported. Caster wheels are often coupled to the base to enable transport over floor surfaces.

Moving a patient transport apparatus, particularly through healthcare facilities having complicated layouts with narrow corridors, tight elevators, and crowded areas, can be difficult with only caster wheels. In some cases, two operators may be required to move the patient transport apparatus, with one operator pushing on a head end of the patient transport apparatus and the other operator steering and/or pulling a foot end of the patient transport apparatus.

Patient transport apparatuses having auxiliary wheel assemblies have been developed to improve maneuverability, reduce demands on operators, and expedite movement of patients. Typically, such auxiliary wheel assemblies comprise one or more auxiliary wheels, which can be selectively raised to a stowed position and lowered to a deployed position. The auxiliary wheels may be power driven in some cases. In the deployed position, the auxiliary wheels are configured to contact a floor surface to roll along the floor surface, but they are generally unable to swivel. Accordingly, lateral movement of the patient transport apparatus is difficult with the auxiliary wheels deployed. As a result, before the patient transport apparatus can be laterally moved, the auxiliary wheels need to be raised back to the stowed position. When the operator wants to again utilize the auxiliary wheels, the auxiliary wheels need to be re-lowered to the deployed position. Constant raising and lowering of the auxiliary wheels between the stowed and deployed positions can be undesirable.

A patient transport apparatus designed to overcome one or more of the aforementioned challenges is desired.

DETAILED DESCRIPTION

Figure 1:
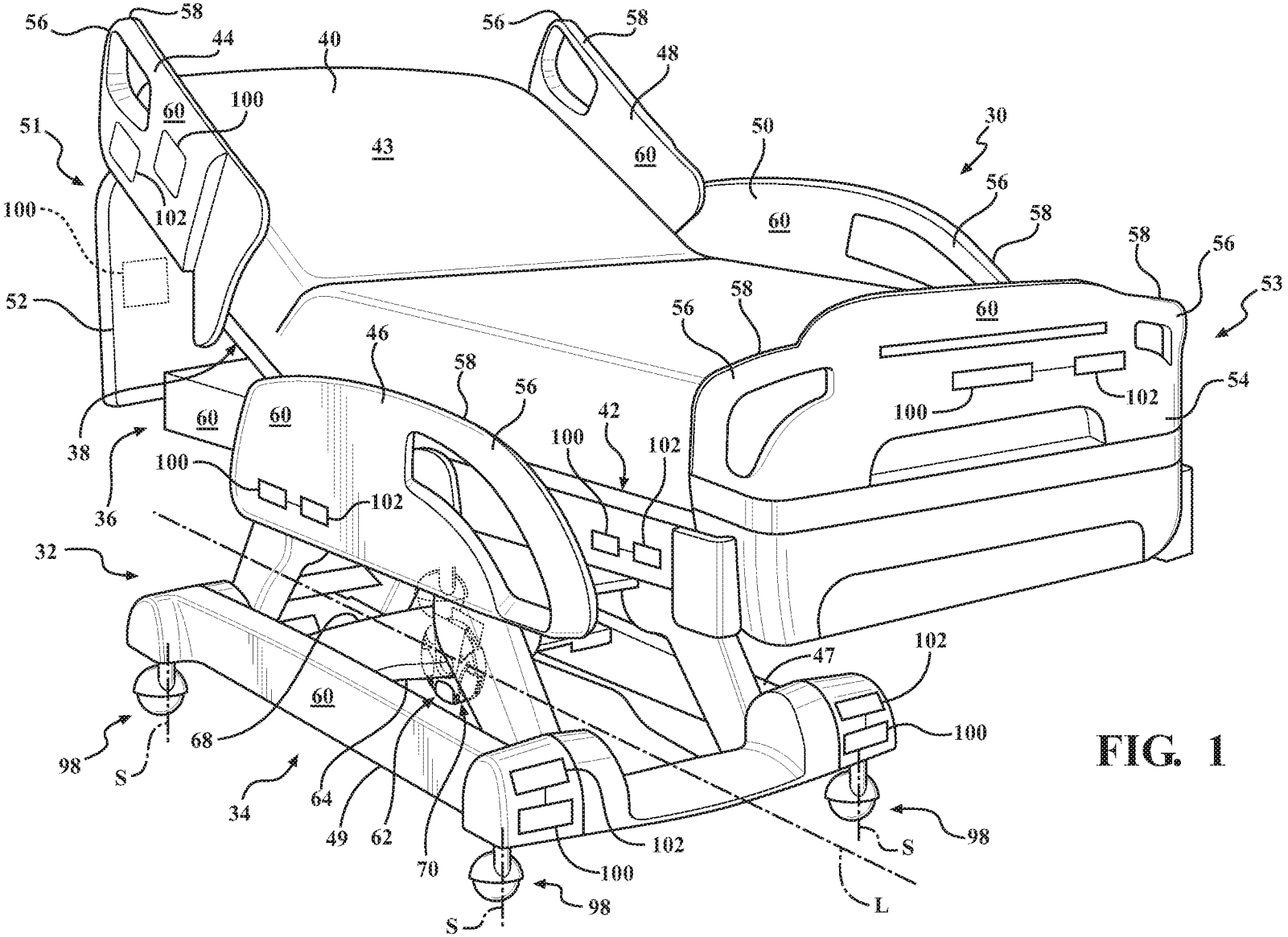
FIG. 1 is perspective view of a patient transport apparatus having a wheel assembly in the form of an omni-directional wheel for facilitating movement along a floor surface.

Referring to FIG. 1, a patient transport apparatus 30 is shown for moving a patient from one location to another. The patient transport apparatus 30 illustrated in FIG. 1 is a hospital bed. In other embodiments, however, the patient transport apparatus 30 may be a stretcher, cot, wheelchair, chair, or similar apparatus.

A support structure 32 provides support for the patient during movement of the patient transport apparatus 30. The support structure 32 illustrated in FIG. 1 comprises a base 34 and an intermediate frame 36. The intermediate frame 36 is spaced above the base 34. The support structure 32 also comprises a patient support deck 38 disposed on the intermediate frame 36. The patient support deck 38 comprises several sections, some of which articulate (e.g., pivot) relative to the intermediate frame 36, such as a head section, a seat section, a thigh section, and a foot section. The patient support deck 38 provides a patient support surface 42 upon which the patient is supported. The patient support surface 42 is supported by the base 34.

A mattress 40 is disposed on the patient support deck 38. The mattress 40 comprises a direct patient support surface 43 upon which the patient is supported. The base 34, intermediate frame 36, patient support deck 38, and patient support surfaces 42, 43 each have a head end and a foot end corresponding to the designated placement of the patient's head and feet on the patient transport apparatus 30. The construction of the support structure 32 may take on any known or conventional design, and is not limited to that specifically set forth above.

Side rails 44, 46, 48, 50 are coupled to the intermediate frame 36 on corresponding left and right sides 47, 49 of the patient transport apparatus 30. A first side rail 44 is positioned at a right head end of the intermediate frame 36 on the right side 49 of the patient transport apparatus 30. A second side rail 46 is positioned at a right foot end of the intermediate frame 36 on the right side 49 of the patient transport apparatus 30. A third side rail 48 is positioned at a left head end of the intermediate frame 36 on the left side 47 of the patient transport apparatus 30. A fourth side rail 50 is positioned at a left foot end of the intermediate frame 36 on the left side 47 of the patient transport apparatus 30. If the patient transport apparatus 30 is a stretcher or a cot, there may be fewer side rails. The side rails 44, 46, 48, 50 are movable between a raised position in which they block ingress and egress into and out of the patient transport apparatus 30 and a lowered position in which they are not an obstacle to such ingress and egress. In some configurations, the side rails 44, 46, 48, 50 are movable to one or more intermediate positions between the raised and lowered positions. In still other configurations, the patient transport apparatus 30 may not include any side rails.

The patient transport apparatus 30 has a longitudinal axis L and head and foot ends 51, 53. A headboard 52 and a footboard 54 are coupled to the intermediate frame 36 at the head and foot ends 51, 53. In other embodiments, when the headboard 52 and footboard 54 are included, the headboard 52 and footboard 54 may be coupled to other locations on the patient transport apparatus 30, such as the base 34. In still other embodiments, the patient transport apparatus 30 does not include the headboard 52 or the footboard 54.

Manual steering interfaces 56, such as grips or handles 58, are shown integrated into the footboard 54 and side rails 44, 46, 48, 50 to steer and/or facilitate movement of the patient transport apparatus 30 over the floor surfaces. Additional manual steering interfaces 56 may be integrated into the headboard 52 and/or other components of the patient transport apparatus 30. The manual steering interfaces 56 are graspable by the operator to manipulate the patient transport apparatus 30 for movement.

Other forms of the manual steering interface 56 are also contemplated. The manual steering interface may comprise one or more handles 58 coupled to the intermediate frame 36. The manual steering interface 56 may simply be a surface 60 on the patient transport apparatus 30 spaced apart from the patient support surfaces 42, 43 and upon which the operator logically applies force to cause movement of the patient transport apparatus 30 in one or more directions, also referred to as a push location. This may comprise one or more surfaces 60 on the intermediate frame 36 or base 34. This could also comprise one or more surfaces 60 on or adjacent to the headboard 52, footboard 54, and/or side rails 44, 46, 48, 50. In other embodiments, the manual steering interface may comprise separate handles for each hand of the operator. For example, the manual steering interface may comprise two handles.

Support wheels 98 are coupled to the base 34 to support the base 34 on a floor surface such as a hospital floor. The support wheels 98 allow the patient transport apparatus 30 to move in any direction along the floor surface by swiveling to assume a trailing orientation relative to a desired direction of movement. In the embodiment shown in FIGS. 1 and 2, the support wheels 98 comprise four swivel wheels, such as caster wheels, each arranged in corner portions 66 of the base 34. The support wheels 98 are able to rotate and swivel about swivel axes S during transport. Each of the support wheels 98 forms part of a caster assembly. Each caster assembly is mounted to the base 34. It should be understood that various configurations of the caster assemblies are contemplated. In some embodiments, the support wheels 98 are not caster wheels and/or may be non-steerable, steerable, non-powered, powered, or combinations thereof. Additional support wheels 98 are also contemplated. The support wheels 98 may comprise spherical caster wheels as shown that are configured to swivel about a swivel axis S and roll along the floor surface in any direction. In the illustrated embodiment, each spherical caster wheel comprises a post mounted to the base 34 and positioned along the swivel axis S for swiveling the spherical caster wheel about the swivel axis S. The post may be spaced apart from a center of the spherical caster wheel and be mounted to an edge of the spherical caster wheel. However, in other embodiments, the post may be mounted to a center of the spherical caster wheel or a portion of the spherical caster wheel, between the edge and the center, e.g. a portion that is one-third the distance from the center to the edge of the spherical caster wheel. Still in other embodiments, the support wheel is a spherical wheel that is not configured as a caster mounted to the base for swiveling about a swivel axis. It is contemplated that the support wheels may comprise other types of wheels. Any number or type of suitable support wheels are contemplated.

Figure 2:
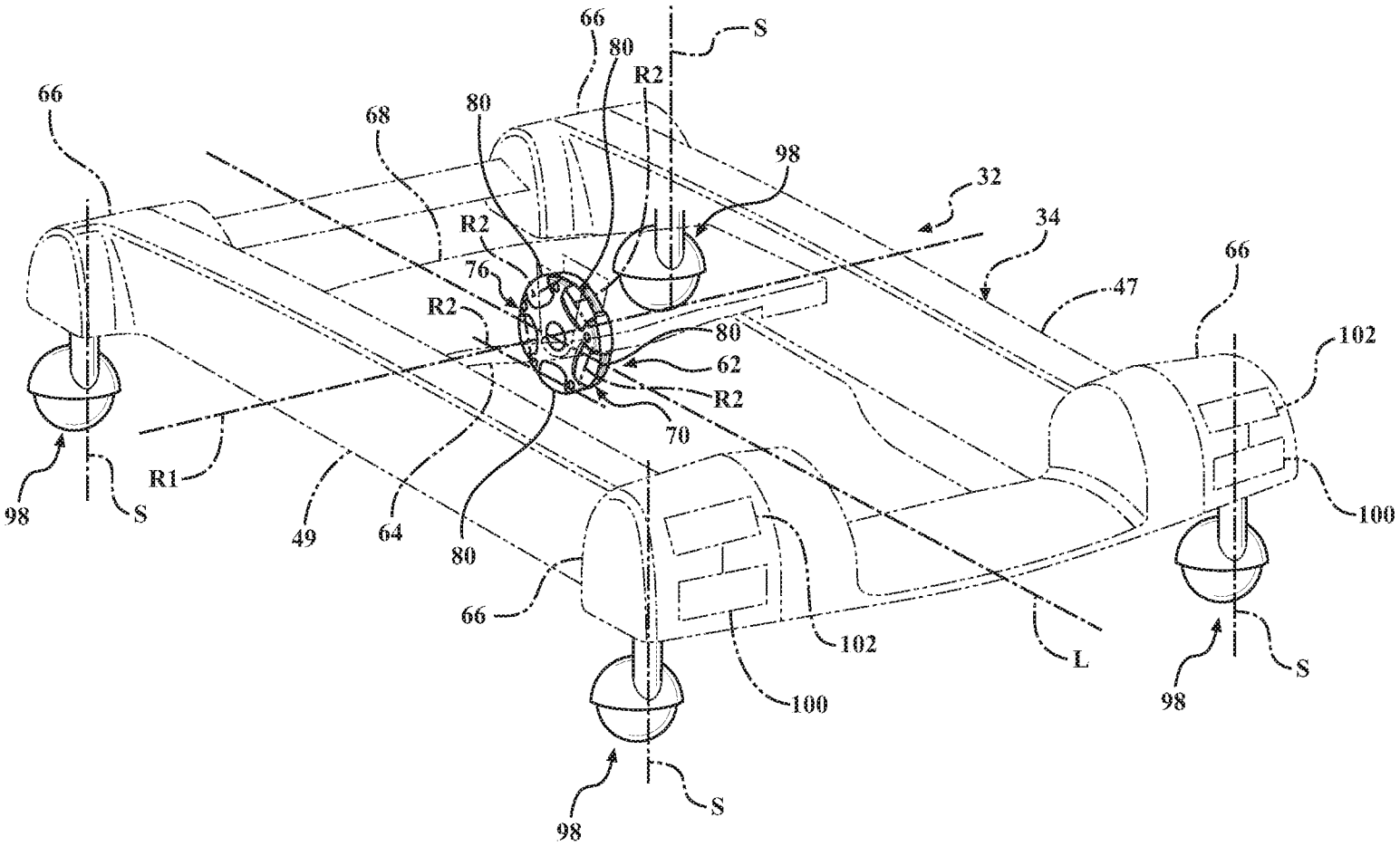
FIG. 2 is a schematic illustration of caster wheels and the omni-directional wheel of FIG. 1.

Referring to FIG. 2, the patient transport apparatus 30 comprises one or more additional wheel assemblies 62 arranged in any suitable configuration. The additional wheel assembly 62 shown is coupled to the support structure 32 to facilitate movement of the patient transport apparatus 30 along the floor surface. One embodiment of the patient transport apparatus 30 may comprise one wheel assembly 62, which is attached to a center portion 64 of the base 34 and positioned radially inward from the corner portions 66 of the base 34. In other embodiments, the wheel assembly 62 may be offset or spaced from the center portion toward the left side 47, the right side 49, the head end 51, the foot end 53, and/or any combination of the same. In the illustrated embodiment, the center portion 64 of the base 34 comprises a cross member 68 extending across the width of the base 34 with the wheel assembly 62 coupled to the cross member 68. The wheel assembly 62 is capable of rolling along the floor surface in more than one direction. The wheel assembly 62 shown in FIG. 2 comprises an omni-directional wheel 70. In other embodiments, the wheel assembly 62 comprises a mecanum wheel or other type of wheel capable of rolling along the floor surface in more than one direction. The patient transport apparatus 30 can include any number of wheel assemblies 62 (as exemplified in FIGS. 8A-26).

Figure 3:
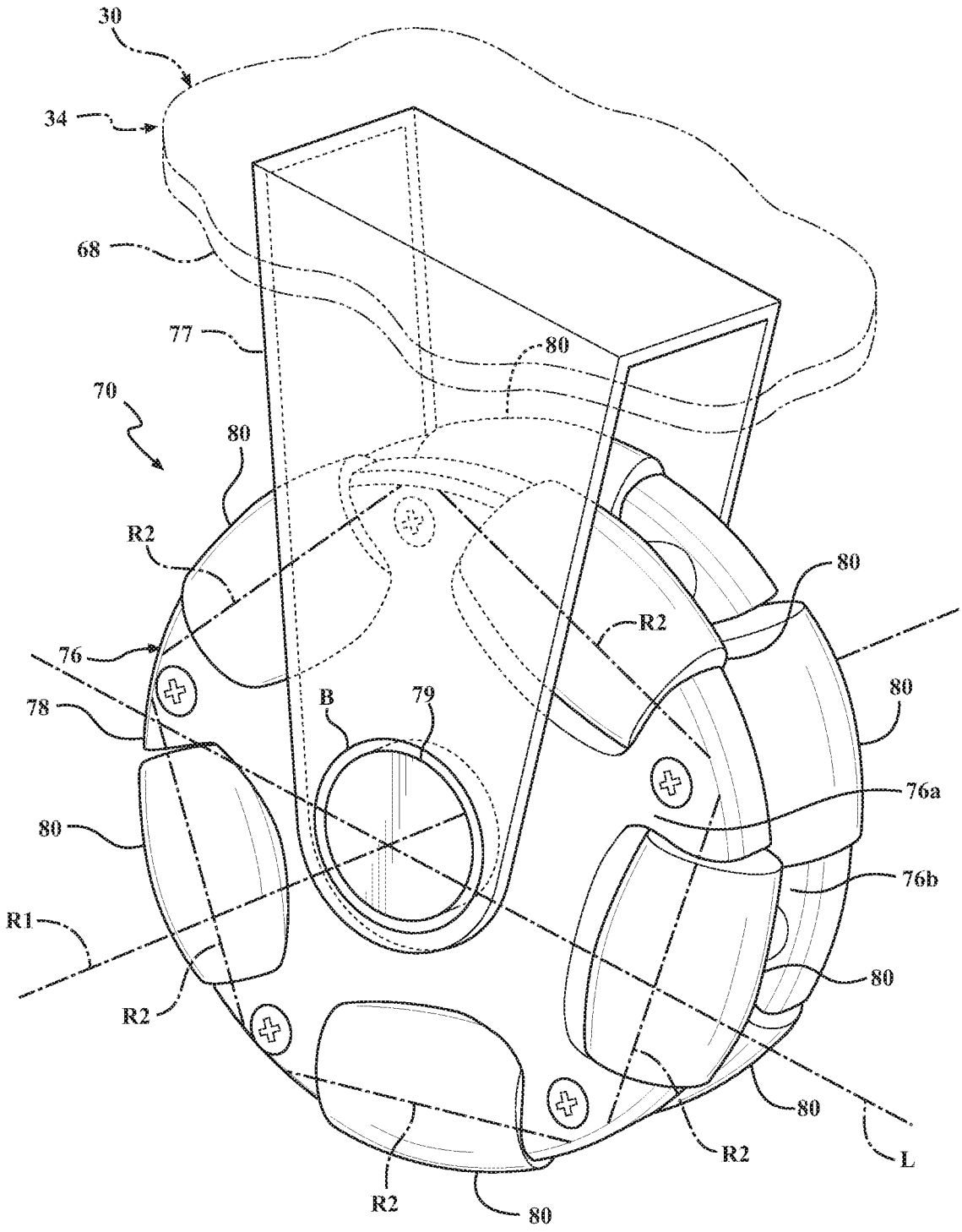
FIG. 3 is a perspective view of the omni-directional wheel of FIG. 2 showing the wheel assembly having a base wheel and peripheral wheels.

Referring to FIG. 3, the omni-directional wheel 70 comprises a base wheel 76 that has an outer periphery 78. The base wheel 76 is coupled to the cross member 68 to rotate about a base rotational axis R1, which is perpendicular to the longitudinal axis L of the patient transport apparatus 30. In the embodiment shown, the base wheel 76 is rotatably coupled to a fork 77, which is in turn fixed to the cross member 68. The base wheel 76, in the embodiment shown, does not swivel relative to the cross member 68, and the base wheel 76 is rotatable within a plane that remains fixed relative to the base 34. Thus, the base wheel 76 rotates about the base rotational axis R1 with movement of the patient transport apparatus 30 in longitudinal directions parallel with the longitudinal axis L. It is contemplated that the base wheel 76 can be attached to other portions of the base 34 in any suitable orientation for enabling movement of the patient transport apparatus 30 in any direction.

In the version shown in FIG. 3, the base wheel 76 comprises two base wheel portions **76*a*, 76*b* spaced from one another on a wheel shaft 79. The wheel shaft 79 is rotatably journaled in the fork 77 via bearings B or similar devices. The base wheel portions 76*a*, 76*b* are fixed to the wheel shaft 79 to rotate together with the wheel shaft 79. In other embodiments, the base wheel 76 rotates about a wheel shaft fixed to the fork 77**. In other embodiments, only a single wheel portion or additional wheel portions are present.

The omni-directional wheel 70 further comprises peripheral wheels 80 (also referred to as rollers) rotatably coupled to the base wheel 76 adjacent the outer periphery 78. The peripheral wheels 80 are rotatably coupled to the base wheel 76 to rotate about peripheral rotational axes R2, which are perpendicularly oriented relative to the base rotational axis R1. The peripheral wheels 80 collectively are disposed radially outwardly from the outer periphery 78 of the base wheel 76 so that the peripheral wheels 80 contact the floor surface, while the base wheel 76 remains spaced from the floor surface. Thus, the peripheral wheels 80 collectively rotate with the base wheel 76 about the base rotational axis R1 with movement of the patient transport apparatus 30 in the longitudinal directions, but one or more of the peripheral wheels 80 rotate about the peripheral rotational axes R2 with movement of the patient transport apparatus 30 in directions transverse to the longitudinal axis L. The omni-directional wheel 70 shown in FIG. 3 comprises ten peripheral wheels 80 rotatably coupled to the outer periphery 78 of the base wheel 76 (a set of five peripheral wheels 80 on each base wheel portion 76*a*, 76*b*). Of course, it is contemplated that the omni-directional wheel 70 can have any number or type of peripheral wheels 80 coupled to any portion of the periphery 78 of the base wheel 76 in any orientation for moving the patient transport apparatus 30 in various directions.

Referring to FIGS. 4A-4E, the omni-directional wheel 70 further comprises one or more motion control devices 82 configured to selectively control rotation of one or more of the peripheral wheels 80 about their respective peripheral rotational axes R2 independent of rotation of the base wheel 76 about the base rotational axis R1. By controlling rotation of the one or more peripheral wheels 80 independently from controlling rotation of the base wheel 76, the omni-directional wheel 70 is capable of controlling movement in various, desirable ways. For instance, if the peripheral wheels 80 are inhibited from rotating about their peripheral rotational axes R2 when they contact the floor surface, but the base wheel 76 is still allowed to rotate about the base rotational axis R1, then the omni-directional wheel 70 acts to reduce dog-tracking of the patient transport apparatus 30 when moving down long hallways, which would otherwise occur if the peripheral wheels 80 were able to freely rotate about their peripheral rotational axes R2. Similarly, the omni-directional wheel 70 would provide better, more stable movement of the patient transport apparatus 30 around corners, since the peripheral wheels 80 are inhibited from rolling about their peripheral rotational axes R2 under the inertia of the patient transport apparatus 30 moving around the corners. Similarly, one or more of the peripheral wheels 80 can be actively driven about their peripheral rotational axes R2 independent of driving the base wheel 76. For instance, if the operator desires to move the patient transport apparatus 30 down a long hallway, the base wheel 76 may be driven, without driving the peripheral wheels 80. Conversely, if the operator desires to move the patient transport apparatus 30 laterally, one or more of the peripheral wheels 80 may be driven, without driving the base wheel 76.

Figure 4A:
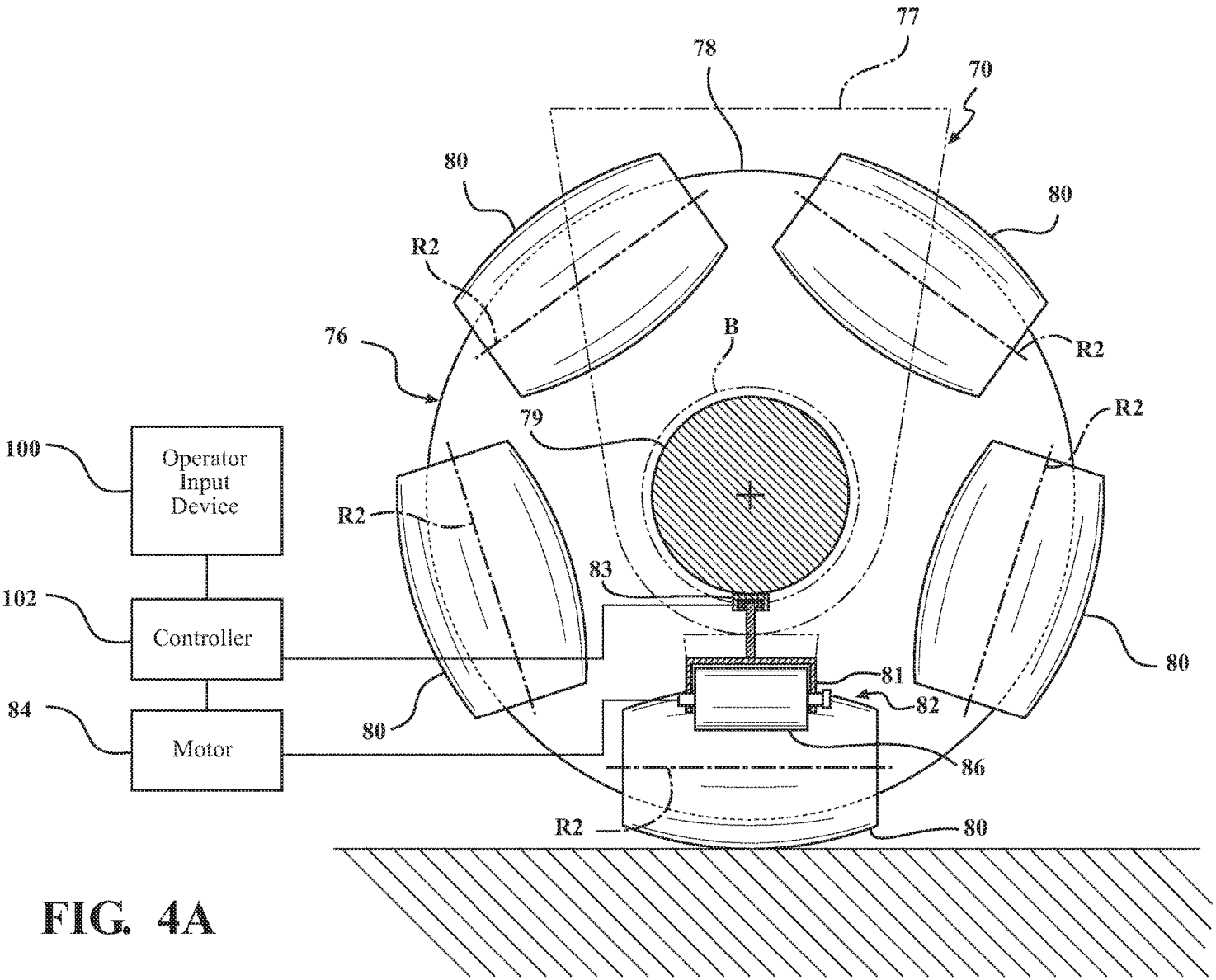
FIG. 4A is a schematic illustration of the omni-directional wheel of FIG. 3 showing a motion control device for controlling the motion of the peripheral wheels.
Figure 4B:
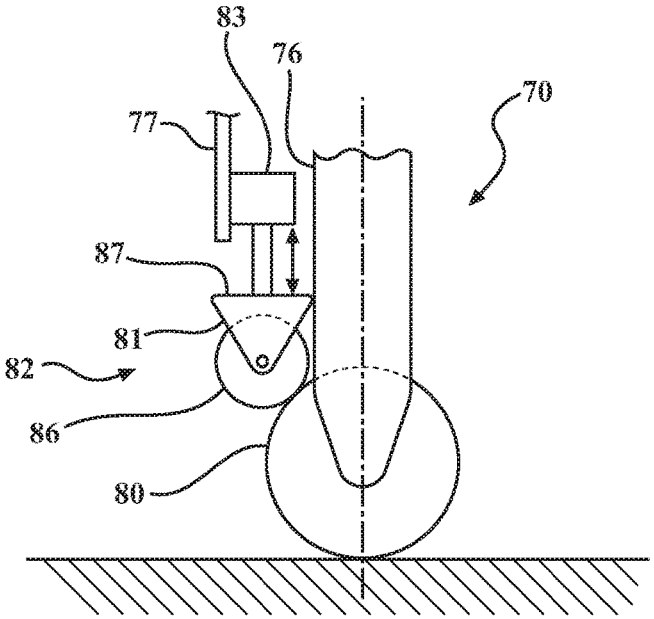
FIG. 4B is a partial view of the motion control device of FIG. 4A positioned to control motion of one of the peripheral wheels.

In the embodiment shown in FIG. 4A, the motion control device 82 comprises a motor 84 and a control wheel 86 actuated by the motor 84. The control wheel 86 is rotatably coupled to a control wheel fork 81. As best shown in FIG. 4B, an actuator 83 extends between the control wheel fork 81 and the fork 77 on which the base wheel 76 is rotatably coupled. The actuator 83 is configured to selectively move the control wheel fork 81 and the control wheel 86 to urge the control wheel 86 against the peripheral wheel 80. The control wheel 86 may be used as a brake to inhibit rotation of the peripheral wheel 80 or as a drive wheel to actively rotate the peripheral wheel 80 about its peripheral rotational axis R2, by virtue of frictional engagement between the control wheel 86 and the peripheral wheel 80. In this embodiment, the actuator 83 may comprise a linear actuator with a housing fixed to the fork 77 and a rod linearly movable relative to the housing. The rod extends from the housing to the control wheel fork 81. The actuator 83 can be any suitable mechanism for selectively moving the control wheel 86 into engagement with one of the peripheral wheels 80. In this arrangement, the control wheel 86 is configured to engage the peripheral wheel 80 that is in contact with the floor surface as shown. In embodiments where the omni-directional wheel 70 comprises two or more base wheel portions 76*a*, 76*b*, like that shown in FIG. 3, a similar motion control device 82 may be arranged on an opposite side of the fork 77. In further embodiments, separate motion control devices 82 may be provided for each of the peripheral wheels 80. In still further embodiments, the control wheels 86 may be in constant frictional contact with their associated peripheral wheels 80 such that the actuator 83 is unnecessary.

Figure 4C:
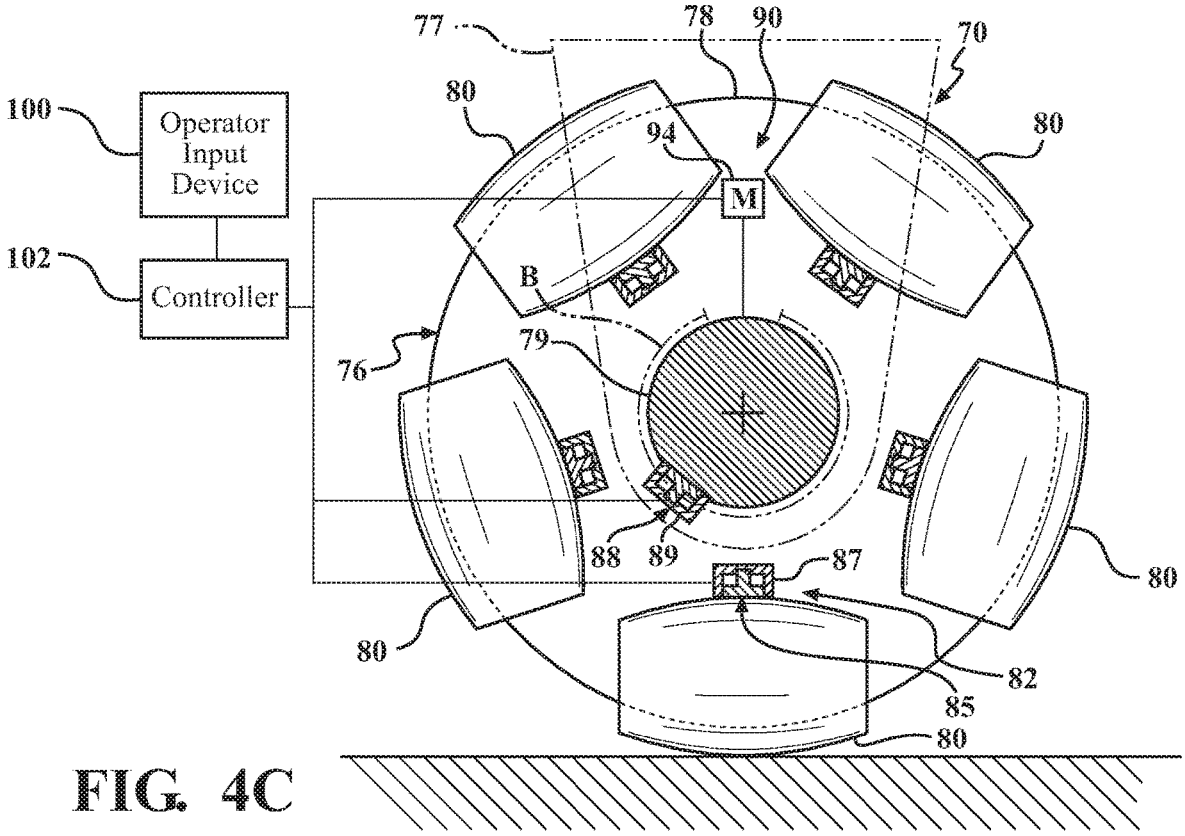
FIG. 4C is a schematic illustration of another motion control device in the form of a brake for controlling the motion of the peripheral wheels.

Referring to FIG. 4C, in another embodiment, the motion control device 82 comprises a brake 85 for selectively inhibiting rotation of at least one of the peripheral wheels 80. While the embodiment of the motion control device illustrated in FIGS. 4A and 4B comprises one brake for controlling the motion of any one of the peripheral wheels 80, the motion control device 82 illustrated in FIG. 4C may comprise a plurality of dedicated brakes for controlling the motion of a respective one of the peripheral wheels 80. More specifically, while the motion control device illustrated in FIGS. 4A and 4B comprises the control wheel 86 operably coupled to the fork 77 to inhibit the rotation of or actively rotate any one of the peripheral wheels 80 positioned immediately beneath the control wheel 86, the motion control device 82 illustrated in FIG. 4C may comprise a plurality of brakes 85 coupled to the base wheel 76 adjacent to a respective one of the peripheral wheels 80. However, it is contemplated that other embodiments of the brakes may be coupled to any portion of the wheel assembly and may be used to control the motion of any of the peripheral wheels 80.

In the illustrated embodiment, each brake 85 may comprise a brake actuator 87 to move a friction surface, or other suitable braking device, to engage the peripheral wheel 80. The brake actuator 87 may be any mechanism suitable to move the friction surface or other suitable braking device to inhibit rotation of the peripheral wheel 80 about the peripheral rotational axis R2. The brake actuator 87 may comprise a linear actuator, solenoid, or other suitable actuator. Drum brakes or other suitable brakes are also contemplated. The brake 85 may be configured to selectively inhibit rotation of only one peripheral wheel 80, when for example the peripheral wheel contacts the floor surface, or to selectively impede rotation of all the peripheral wheels 80 at the same time. It is contemplated that the omni-directional wheel 70 may comprise any number of suitable brakes mounted to any portion of the wheel assembly for selectively inhibiting rotation of the peripheral wheels 80. In some cases, the brakes 85 only need to slightly inhibit rotation of the peripheral wheels 80 about their peripheral rotational axes R2, such as when employing the omni-directional wheels 70 to transport the patient down a long hallway. In this case, some rotation of the peripheral wheels 80 about their respective peripheral rotational axes R2 is tolerable so long as they are at least partially impeded from freely rotating.

The omni-directional wheel 70 may also comprise a base brake 88 for selectively impeding rotation of the base wheel 76. The base brake 88 may comprise a brake actuator 89 mounted to the fork 77 or any other suitable part of the patient transport apparatus 30 to move a friction surface, or other suitable braking device, to engage the wheel shaft 79 of the base wheel 76. However, drum brakes or other suitable brakes are contemplated. The omni-directional wheel 70 may comprise any suitable brake for selectively inhibiting rotation of the base wheel 76.

The brakes 85 for the peripheral wheels 80 and the base brake 88 for the base wheel 76 are actuated independently and/or in conjunction with one another to control the motion of the patient transport apparatus 30 along the floor surface or to selectively hold the patient transport apparatus 30 in a fixed location on the floor surface. As one example, the brakes 85 may be actuated to prevent rotation of the peripheral wheels 80 about their respective peripheral rotational axes R2, and the base brake 88 may not be actuated so as to permit rotation of the base wheel 76 about the base rotational axis R1 such that the patient transport apparatus 30 is constrained in a manner that facilitates moving down long hallways or around corners as previously described. As another example, the base brake 88 may be actuated to prevent rotation of the base wheel 76 about the base rotational axis R1, and the brakes 85 may not be actuated so as to permit free rotation of the peripheral wheels 80 such that the patient transport apparatus 30 is constrained from moving purely longitudinally, but is able to move transversely to the longitudinal axis L, such as in a lateral direction perpendicular to the longitudinal axis L. In still other examples, the brakes 85 and the base brake 88 are selectively actuated to constrain/permit movement of the patient transport apparatus 30 in various directions along the floor surface other than the longitudinal and lateral directions.

Still referring to FIG. 4C, the omni-directional wheel 70 may comprise a base wheel drive 90 for controlling rotation of the base wheel 76. In this embodiment, the base wheel drive 90 comprises a drive device, which is operably coupled to the base wheel 76 to control rotation of the base wheel 76. The drive device may comprise a drive motor 94 for rotating the wheel shaft 79 about the base rotational axis R1. The drive motor 94 may be mounted to the fork 77 or any other suitable part of the patient transport apparatus 30. The drive motor 94 may comprise a drive shaft to directly drive the wheel shaft 79 or may comprise one or more drive shafts, drive gears, and/or transmissions to drive the base wheel 76. The base wheel drive 90 can have other suitable configurations or be omitted from the omni-directional wheel 70, such that the omni-directional wheel 70 is non-driven.

Figure 4D:
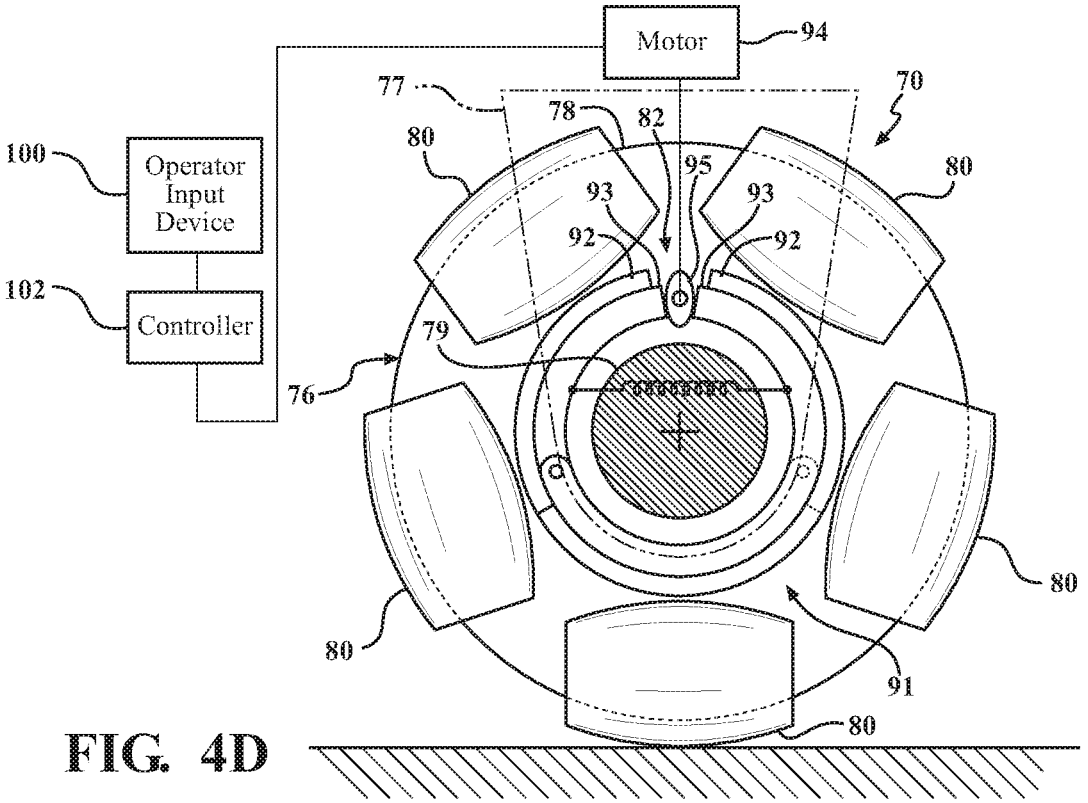
FIG. 4D is a schematic illustration of another embodiment of the brake for controlling the motion of the peripheral wheels, with the brake disposed in an unbraked mode.
Figure 4E:
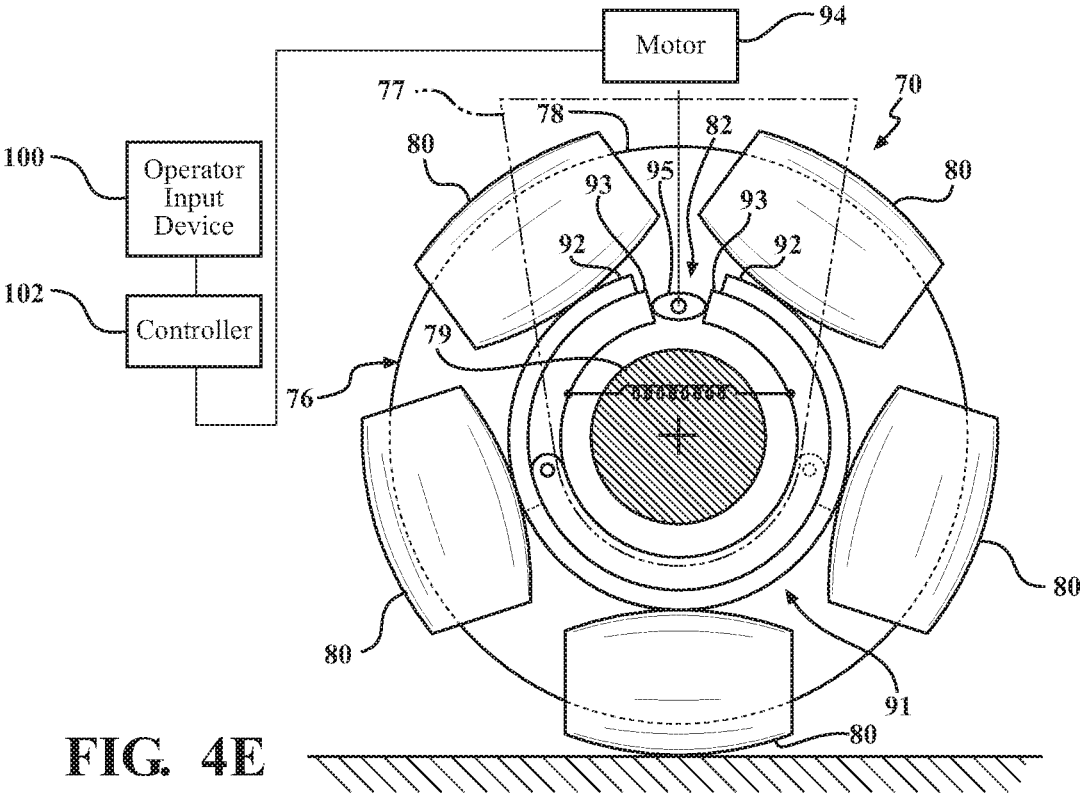
FIG. 4E is a schematic illustration of the brake of FIG. 4C, with the brake disposed in a braked mode.

Referring to FIGS. 4D and 4E, in another embodiment, the motion control device 82 comprises a drum brake 91 movable between an unbraked mode (FIG. 4D) for permitting the rotation of all the peripheral wheels 80 at the same time and a braked mode (FIG. 4E) for inhibiting the rotation of all the peripheral wheels 80 at the same time. The drum brake 91 comprises two brake linings 92 attached to two brake shoes 93 that are pivotally attached to the base wheel 76. A brake actuator (e.g., motor) is coupled to a cam 95 to rotate the cam 95 and urge the brake linings 92 against all of the peripheral wheels 80 simultaneously to inhibit rotation of the same.

Figure 4F:
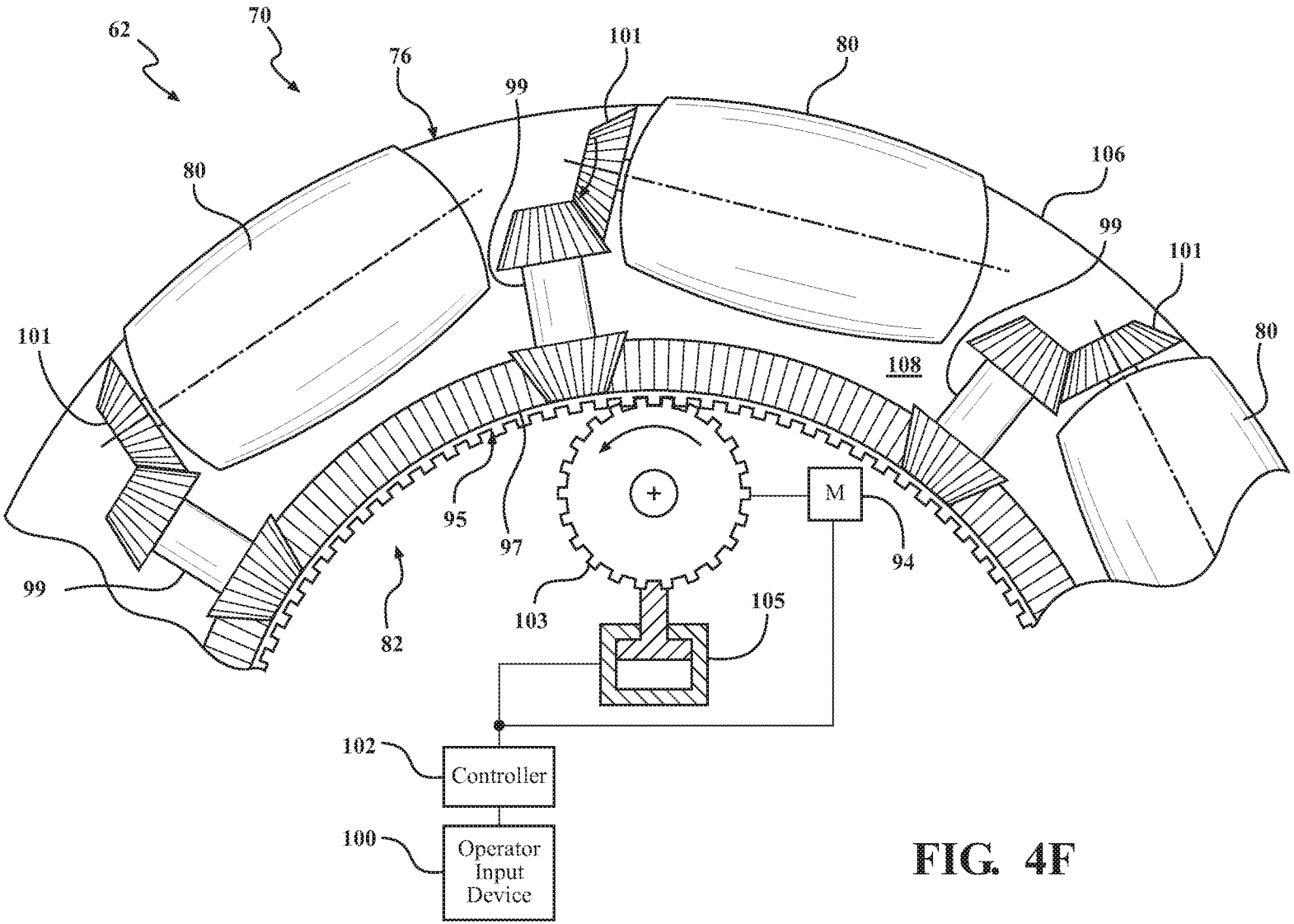
FIG. 4F is an enlarged cutaway view of another motion control device for controlling rotation of the peripheral wheels.

Referring to FIG. 4F, in another embodiment, the motion control device 82 may comprise a gear train 95 configured to drive one or more peripheral wheels 80 independent of the rotation of the base wheel. The gear train 95 comprises a crown gear 97, which is rotatably coupled to the base wheel 76 for rotating independent of the rotation of the base wheel 76. The crown gear 97 is engaged with pinion gears 99, which are in turn engaged with bevel gears 101 fixedly attached to the peripheral wheels 80. A control gear 103 is carried by the base wheel 76 to independently rotate relative to the base wheel 76 during operation, and drive the peripheral wheels 80 independent of the rotation of the base wheel 76. A motor 104 selectively rotates the control gear 103 to rotate the crown gear 97. An actuator 105 is coupled to the base wheel 76 for selectively moving the control gear 103 in/out of meshing engagement with radially inward teeth of the crown gear 97. When engaged, the control gear 103 may act as a brake to inhibit motion of the crown gear 97 relative to the base wheel 76 or may be actively driven to rotate the crown gear 97 relative to the base wheel 76. When not engaged, the crown gear 97 is able to freely rotate relative to the base wheel 76 thereby allowing free rotation of the peripheral wheel 80 in contact with the floor surface. Other embodiments of the bevel gear train 95 may comprise a clutch selectively coupling the control gear 103 to the crown gear 97. The wheel assembly 62 may comprise a housing 106 that defines an internal cavity 108 with the motion control device 82 being disposed within the internal cavity 108. Other suitable motion control devices, base wheel drives, or combinations of the same are contemplated.

Figure 5A:
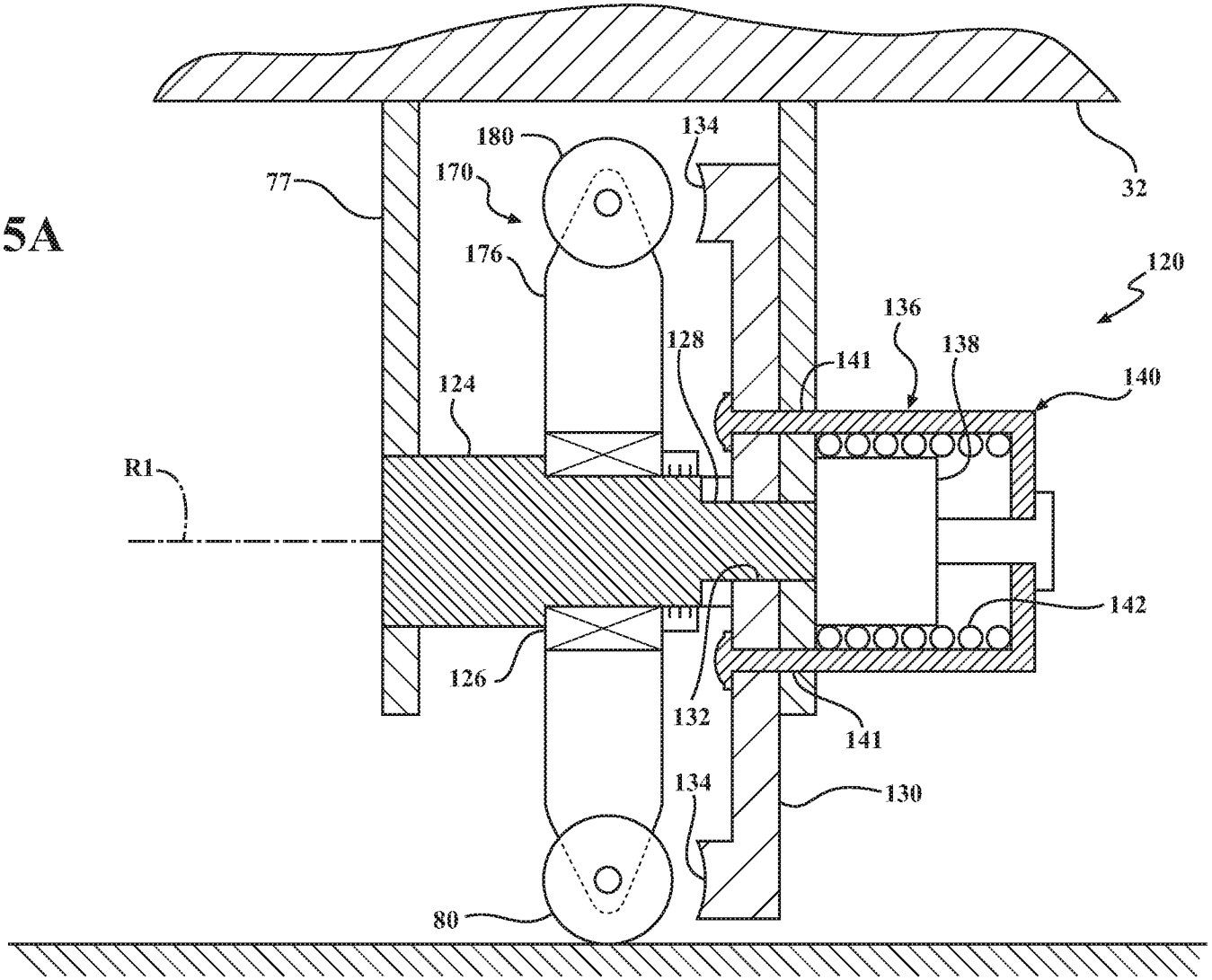
FIG. 5A is a schematic illustration of another omni-directional wheel with a brake for controlling the motion of the base wheel and peripheral wheels, with the brake disposed in an unbraked mode.
Figure 5B:
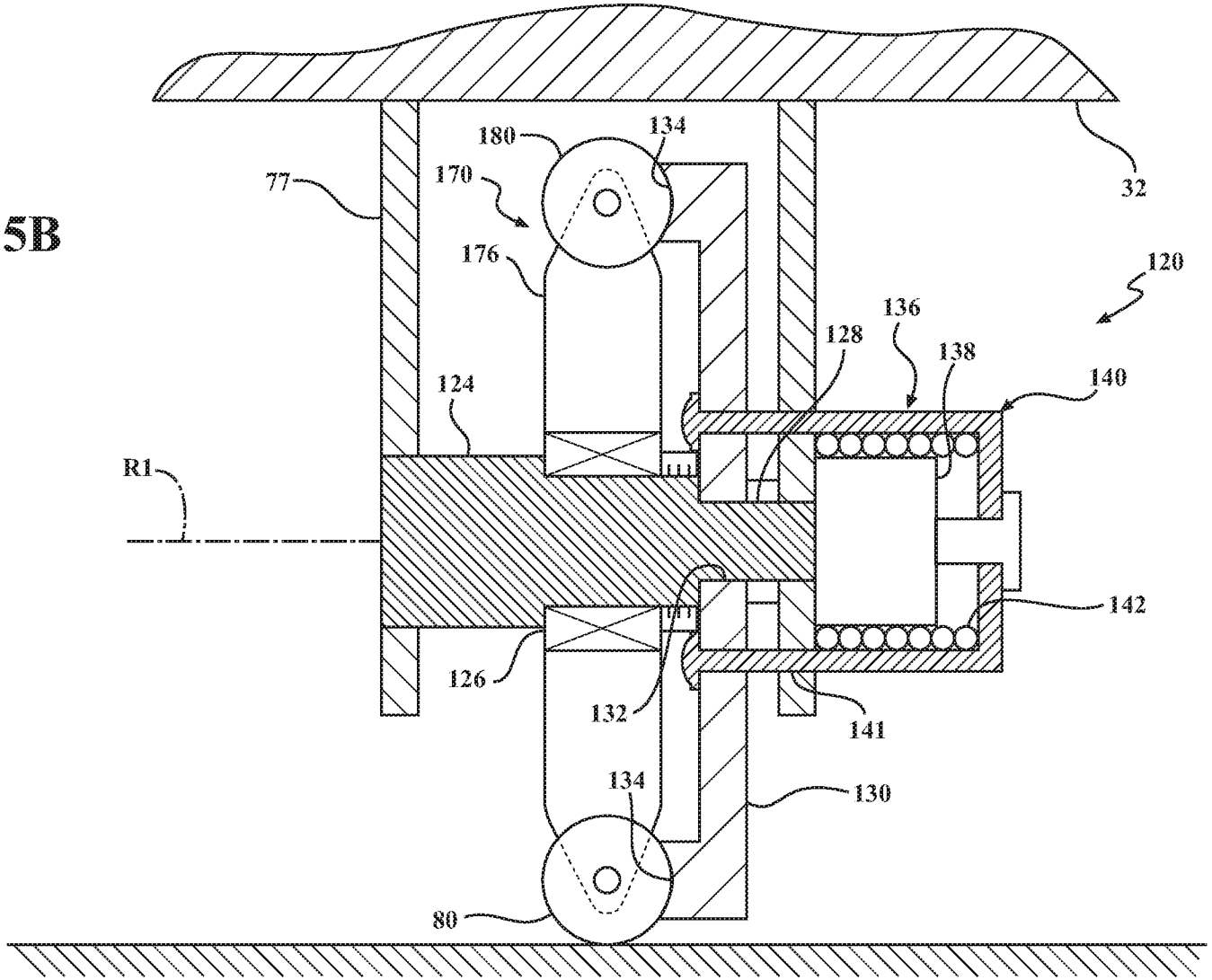
FIG. 5B is a schematic illustration of the brake of FIG. 5A, with the brake disposed in a braked mode.

FIGS. 5A and 5B illustrate another embodiment of an omni-directional wheel 170 with only a single wheel portion 176. In this embodiment, a brake 120 acts to engage the omni-directional wheel 170 in a manner that inhibits rotation of a base wheel 176 about the base rotational axis R1 and inhibits rotation of peripheral wheels 180 about the peripheral rotational axes R2 at the same time. The brake 120 moves between an unbraked mode (FIG. 5A) for permitting the rotation of all the peripheral wheels 180 about the peripheral rotational axes R2 and a braked mode (FIG. 5B) for inhibiting the rotation of all the peripheral wheels 180 about the peripheral rotational axes R2 at the same time. In this embodiment, the omni-directional wheel 170 is rotatably coupled to a fixed shaft 124 by a bearing 126. The fixed shaft 124 is in turn fixedly attached to the fork 77. The fixed shaft 124 comprises a splined portion 128 having splines.

The brake 120 comprises a disc 130 having a splined opening 132 that receives the splined portion 128 of the fixed shaft 124 such that their corresponding splines engage in a mating relationship that enables the disc 130 to slide laterally along the splined portion 128 without being able to rotate about the splined portion 128. The disc 130 slides toward the omni-directional wheel 170 to engage the omni-directional wheel 170 in the braked mode and slides away from the omni-directional wheel 170 to be disengaged from the omni-directional wheel 170 in the unbraked mode.

The disc 130 comprises a periphery and a plurality of frictional contact surfaces 134 positioned about the periphery for contacting the peripheral wheels 180 and inhibiting movement of the same. The disc 130 and the contact surfaces 134 may be integral portions of a one-piece rubber body. However, separate discs and/or contact surfaces and/or other suitable materials are contemplated. An actuator assembly 136 is coupled to the fork 77 and configured to move the disc 130 between its positions associated with the braked mode and the unbraked mode. The actuator assembly 136 may comprise an actuator 138 having a movable rod fixed to a disc carrier 140 that holds the disc 130. The disc carrier 140 is fixed to the disc 130 and comprises guide rods 141 arranged to slide within openings in the fork 77 upon operation of the actuator 138. The actuator 138 may comprise a linear actuator or other suitable type of actuator. The brake 120 may comprise a biasing member 142 arranged between the fork 77 and the disc carrier 140 for normally moving the disc 130 to its position associated with the unbraked mode.

In the braked mode, owing to the frictional engagement of the frictional contact surfaces 134 with the peripheral wheels 180 and the splined portion 128 generally impeding rotation of the disc 130 about the base rotational axis R1, not only are the peripheral wheels 180 inhibited from rotating about their peripheral rotational axes R2, but the base wheel 176 is also inhibited from rotation about the base rotational axis R1.

Figure 5C:
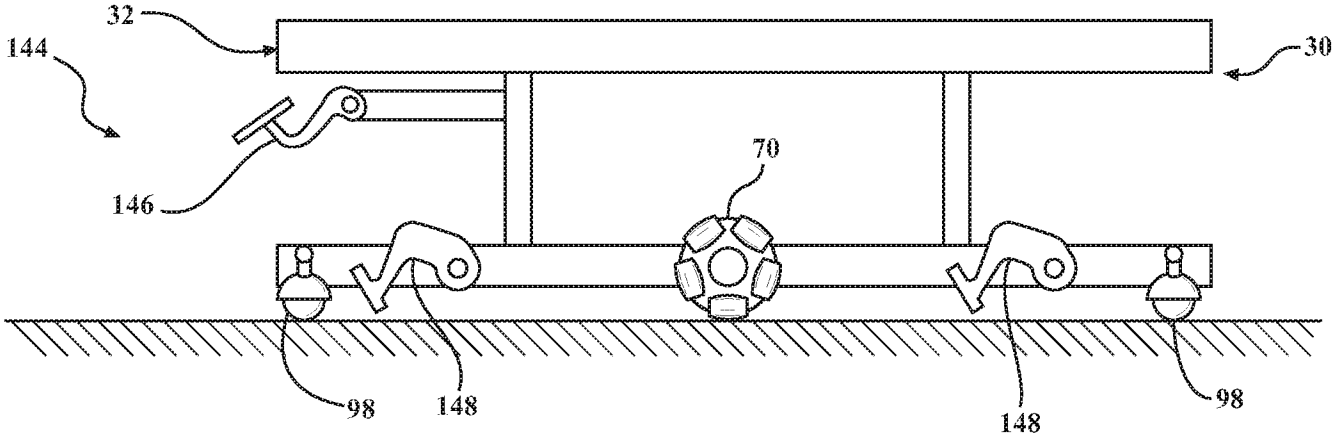
FIG. 5C is a schematic illustration of a support structure of the patient transport apparatus having one or more pedestals and pedals in a stowed position for placing the omni-directional wheel and support wheels into contact with the floor surface.
Figure 5D:
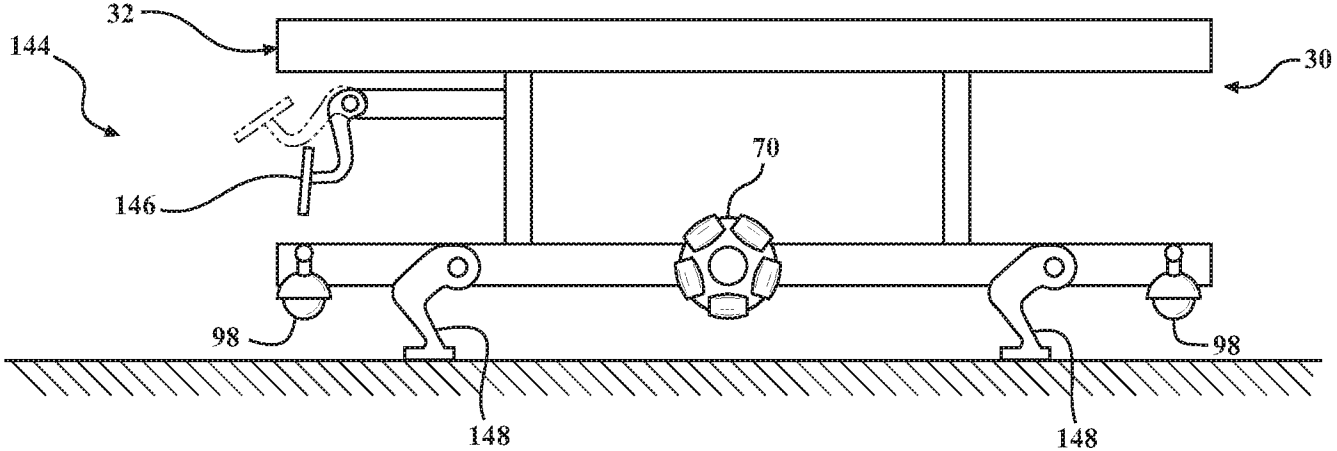
FIG. 5D is a schematic illustration of the support structure of FIG. 5C, with the pedestals and pedals in a deployed position for raising the omni-directional wheel and support wheels above the floor surface and preventing movement of the patient transport apparatus along the floor surface.

Referring to FIGS. 5C and 5D, in another embodiment, the support structure 32 may comprise a brake 144 and/or a pedal 146 for actuating the brake 144. The brake 144 may merely engage the floor surface in a frictional manner that inhibits movement of the patient transport apparatus 30 and/or the brake 144 may lift one or more support wheels 98 and/or the omni-directional wheel 70 above the floor surface. As shown in FIG. 5D, floor brakes may be employed to inhibit movement of the omni-directional wheel 70 along the floor surface. The floor brakes may comprise deployable pedestals 148 that are actuated by the pedal 146 to be raised above the floor surface during transport (FIG. 5C) and actuated by the pedal 146 to be lowered into contact with the floor surface during braking (FIG. 5D).

Figure 6:
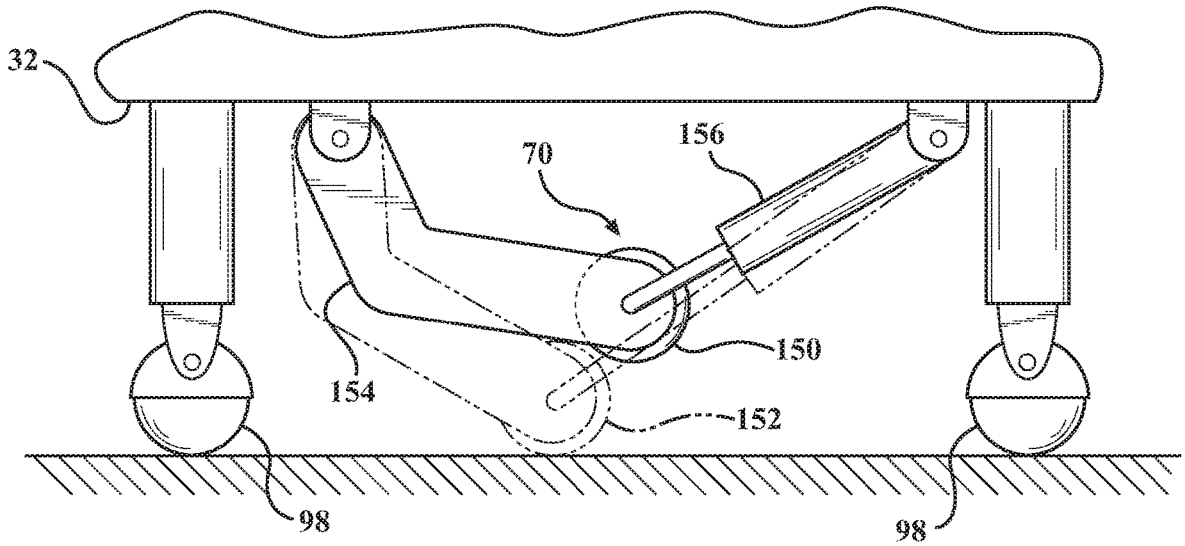
FIG. 6 is a schematic illustration of a deployable omni-directional wheel that can be raised above the floor surface or lowered into contact with the floor surface.

Referring to FIG. 6, in some embodiments, the omni-directional wheel 70 may be deployable from a stowed position 150 above the floor surface to a deployed position 152 in contact with the floor surface. A support arm 154 can be pivotally coupled to the support structure 32, and the omni-directional wheel 70 can be rotatably coupled to an end of the support arm 154. An actuator 156, such as a linear actuator, can be coupled to the omni-directional wheel 70 and/or the support arm 154 for moving the omni-directional wheel 70 between the stowed position 150 and the deployed position 152.

Figure 7A:
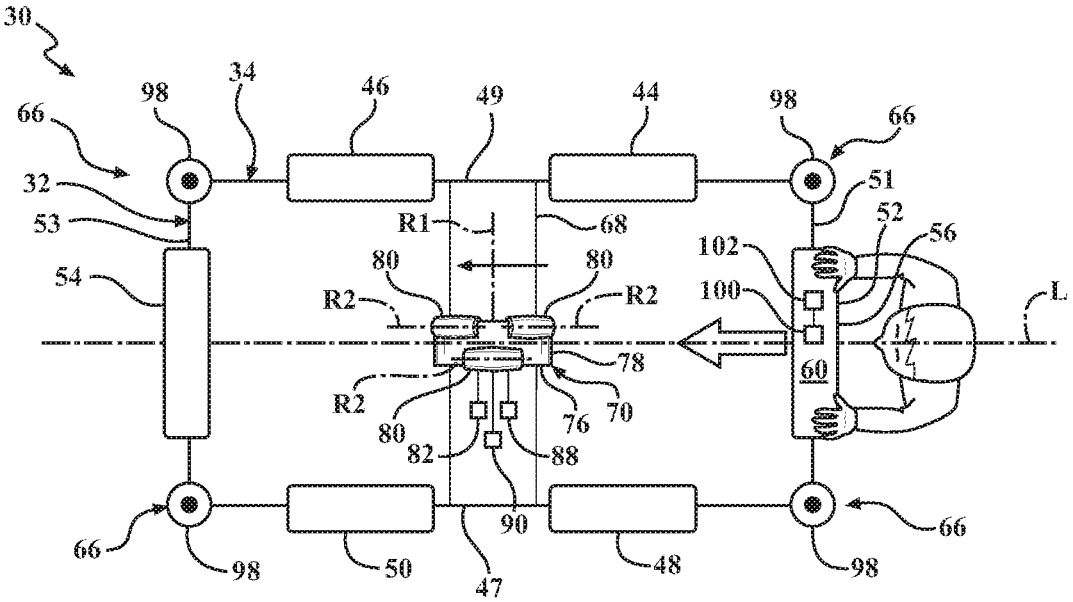
FIG. 7A is a schematic illustration of an operator pushing on a headboard to move the patient transport apparatus of FIG. 1.
Figure 7B:
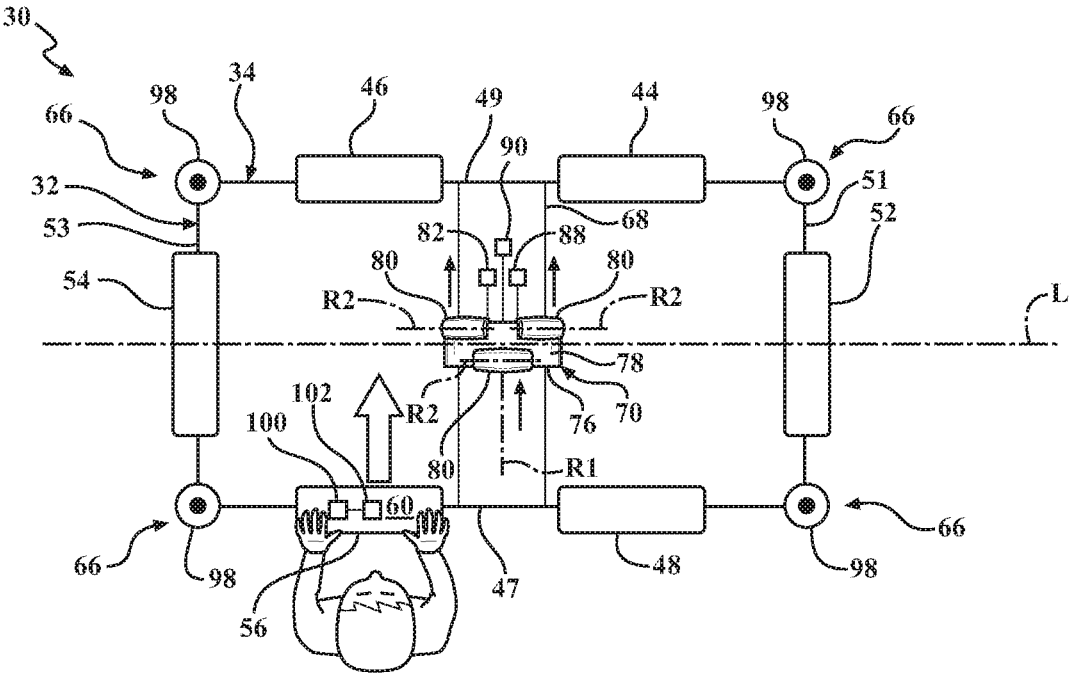
FIG. 7B is a schematic illustration of the operator pushing on a side rail to move the patient transport apparatus of FIG. 7A.

Referring to FIGS. 7A and 7B, a control system is provided to control operation of the wheel assembly 62, and specifically the one or more motion control devices 82, the base brake 88, and the base wheel drive 90, and any other powered devices that may be located on the patient transport apparatus 30. In particular, the control system is electrically coupled to the actuators and motors of the motion control devices 82, the base brake 88, and the base wheel drive 90 recited herein for controlling the same. The actuators described herein may comprise electric actuators, hydraulic actuators, pneumatic actuators, combinations thereof, or any other suitable types of actuators for performing the functions described. The motors described herein may comprise electric motors, brushed motors, brushless motors, stepper motors, servo motors, combinations thereof, or any other suitable types of motors for performing the functions described.

The control system comprises a controller 102 having one or more microprocessors for processing instructions or for processing algorithms stored in memory to control operation of the motion control devices 82, base brake 88, base wheel drive 90, and other powered devices. Additionally or alternatively, the controller 102 may comprise one or more microcontrollers, field programmable gate arrays, systems on a chip, discrete circuitry, and/or other suitable hardware, software, or firmware that is capable of carrying out the functions described herein. The memory may further store one or more look-up tables that define control parameters of the motion control devices 82, base brake 88, base wheel drive 90, and other powered devices. The controller 102 may be carried on-board the patient transport apparatus 30, or may be remotely located. In one embodiment, the controller 102 is mounted to the base 34. The controller 102 may comprise one or more sub-controllers configured to control all motion control devices 82, base brake 88, base wheel drive 90, and the other powered devices or one or more sub-controllers for each of the motion control devices 82, base brake 88, base wheel drive 90, and the other powered devices. Power to the motion control devices 82, base brake 88, base wheel drive 90, or other powered devices and/or the controller 102 may be provided by a power storage system, such as a battery system.

The controller 102 is coupled to the motion control devices 82, base brake 88, and base wheel drive 90 in a manner that allows the controller 102 to control them. The controller 102 may electrically communicate with the motion control devices 82, base brake 88, and/or base wheel drive 90 via wired or wireless connections. The controller 102 generates and transmits control signals to the motion control devices 82, base brake 88, and/or base wheel drive 90, or components thereof, to perform one of more desired movements or functions. The controller 102 may monitor an actual state of the motion control devices 82, base brake 88, and/or base wheel drive 90, and determine desired states to which the motion control devices 82, base brake 88, and/or base wheel drive 90 should be placed, based on one or more input signals that the controller 102 receives from one or more input devices. The state of the motion control devices 82, base brake 88, and/or base wheel drive 90 may be a position, a relative position, a speed, a force, a load, a current, an energization status (e.g., on/off), or any other parameter of the motion control devices 82, base brake 88, and/or base wheel drive 90. The input devices used to control operation of the motion control devices 82, base brake 88, and/or base wheel drive 90 comprises operator input devices 100 and/or a sensing system in communication with (e.g., coupled to) the controller 102.

In one embodiment, the operator input devices 100 used to control operation of the motion control devices 82, base brake 88, and/or base wheel drive 90 comprise operator input devices 100 activated by caregivers or other users, which transmit corresponding input signals to the controller 102. The controller 102 controls operation of the motion control devices 82, base brake 88, and/or base wheel drive 90 based on the input signals. In one embodiment, the operator input devices 100 are located on one or more control panels. It is to be appreciated that control panels could be coupled to one or more of the headboard 52, the footboard 54, the intermediate frame 36, the patient support deck 38, any combination of the side rails 44, 46, 48, 50, or any other suitable location.

The operator input devices 100 receive commands or selections from an operator that is indicative of a desired motion of the patient transport apparatus 30. The controller 102 may receive an input signal from the operator input device 100 based on the operator's inputted command or selection for actuating the motion control devices 82 to control rotation of the peripheral wheels 80 independently of the rotation of the base wheel 76. The controller 102 may also be used for actuating the base brake 88 or the base wheel drive 90 to control rotation of the base wheel 76 based on the input signal received from the operator input device 100. The operator input device 100 may comprise a touch screen having touch-selectable buttons that can be selected by the operator to place the patient transport apparatus 30 in a desired mobility configuration and indicate which direction the operator intends to move the patient transport apparatus 30, i.e., the direction of desired movement of the patient transport apparatus 30. This could be as simple as the touch screen having touch-selectable buttons corresponding to each of the longitudinal and lateral directions of the bed, namely forward, backward, left, and right (as observed when at the operator input device 100 on the headboard 52). The operator input devices 100 may also comprise sensors that communicate with the controller 102 to determine the desired motion of the patient transport apparatus 30, as described in U.S. Patent Application Publication No. 2016/0089283 to DeLuca et al., hereby incorporated by reference.

The operator input device 100 may have user input selections available to the operator such as "brake," "free," "free forward/rearward," "free left/right," "drive forward," "drive rearward," "drive left," "drive right," "increase speed," "decrease speed," other suitable selections, or any combination thereof. For instance, the "brake" selection places the motion control devices 82 and the base brake 88 in the braked mode, and the "free" selection places the motion control devices and the base brake 88 in the unbraked mode.

Referring to FIG. 7A, the "free forward/rearward" selection inhibits rotation of one or more of the peripheral wheels 80 about the corresponding peripheral rotational axis R2 associated with moving the patient transport apparatus 30 in the left/right direction and permits the base wheel 76 to rotate about the base rotational axis R1. In the embodiments shown, the operator can input or select the "free forward/rearward" selection using the operator input device 100. The operator input device 100 can generate an input signal based on the "free forward/rearward" selection and transmit the input signal to the controller 102. The controller 102 places the motion control devices 82 in the braked mode in response to the input signal, so as to inhibit rotation of the associated peripheral wheels 80 and inhibit corresponding movement of the patient transport apparatus 30 in the left/right direction. The controller 102 also places the base brake 88 in the unbraked mode to permit the base wheel 76 to freely rotate, such that the operator can engage the manual steering interface 56 to move the patient transport apparatus 30 in the forward/rearward directions parallel with the longitudinal axis L, including around corners.

Similar to the "free forward/rearward" selection, the "drive forward" and "drive rearward" selections inhibit rotation of the peripheral wheels 80 associated with moving the patient transport apparatus 30 in the left/right direction and permit the base wheel 76 to rotate for moving the patient transport apparatus 30 in the forward/rearward direction. The operator input device 100 can generate an input signal based on the "drive forward" or "drive rearward" selection and transmit the input signal to the controller 102. The controller 102 places the motion control device 82 in the braked mode in response to the input signal, so as to inhibit rotation of the peripheral wheels 80 and prevent corresponding movement in the left/right direction. The controller 102 also places the base brake 88 in the unbraked mode to permit the base wheel 76 to freely rotate so as to move the patient transport apparatus 30 in the forward/rearward directions parallel with the longitudinal axis L. In contrast to the "free forward/rearward" selection, the "drive forward" and "drive rearward" selections further actuate the base wheel drive 90 to rotate the base wheel 76 to drive the patient transport apparatus 30 in the corresponding forward or rearward directions. More specifically, in the embodiments shown, the controller 102 further actuates the base wheel drive 90 to rotate the base wheel 76 for moving the patient transport apparatus 30 in a forward direction parallel with the longitudinal axis L with the footboard 54 leading, when the controller 102 receives the input signal based on the "drive forward" selection. Similarly, the controller 102 further actuates the base wheel drive 90 to rotate the base wheel 76 for moving the patient transport apparatus 30 in the rearward direction parallel with the longitudinal axis L with the headboard 52 leading when the input signal is based on the "drive rearward" selection.

Referring to FIG. 7B, the "free left/right" selection inhibits rotation of the base wheel 76 about the base rotational axis R1, yet permits the peripheral wheels 80 to rotate about their peripheral rotational axes R2 for moving the patient transport apparatus 30 in the left/right direction transverse to the longitudinal axis. In the embodiments shown, the operator can select the "free left/right" selection on the operator input device 100. The operator input device 100 can generate an input signal based on the "free left/right" selection and transmit the input signal to the controller 102. The controller 102 places the base brake 88 in the braked mode in response to the input signal, so as to inhibit rotation of the base wheel 76. The controller 102 also places the motion control device 82 in the unbraked mode to permit the peripheral wheels 80 to freely rotate about their peripheral rotational axes R2 (while braked about the base rotational axis R1 along with the base wheel 76), such that the operator can engage the manual steering interface 56 to move the patient transport apparatus 30 in the left/right directions transverse to the longitudinal axis L, such as laterally relative to the longitudinal axis L.

Similar to the "free left/right" selection, the "drive left" and "drive right" selections inhibit rotation of the base wheel 76 about the base rotational axis R1, yet permits the peripheral wheels 80 to rotate about their peripheral rotational axis R2 for moving the patient transport apparatus 30 in the left/right direction transverse to the longitudinal axis L. In the embodiments shown, the operator can input or select the "drive left" selection or the "drive right" selection on the operator input device 100 and transmit a corresponding input signal to the controller 102. The controller 102 places the base brake 88 in the braked mode in response to the input signal, so as to inhibit rotation of the base wheel 76. Additionally, the controller 102 actuates the motion control device 82 to actively drive and rotate one or more of the peripheral wheels 80, such as the peripheral wheel 80 in contact with the floor surface, to move the patient transport apparatus 30 in the corresponding left or right directions. More specifically, the controller 102 further actuates the motion control device 82 to rotate the peripheral wheel 80 for moving the patient transport apparatus 30 in a left direction perpendicular to the longitudinal axis L, when the controller 102 receives the input signal based on the "drive left" selection. Similarly, the controller 102 further actuates the motion control device 82 to rotate the peripheral wheel 80 for moving the patient transport apparatus 30 in a right direction perpendicular to the longitudinal axis L when the input signal is based on the "drive right" selection.

The "increase speed" or "decrease speed" selections can generate input signals transmitted from the operator input device 100 to the controller 102, which in turn actuates the base wheel drive 90 and/or the motion control device 82 to adjust the speed of the patient transport apparatus 30 based on the input signals. As but one example, the "increase speed" and "decrease speed" selections can be inputted into the operator input device 100 to incrementally increase or decrease the speed of the patient transport apparatus 30 in the forward direction, rearward direction, left direction, or right direction, or combinations thereof, if a corresponding one or more of the "drive forward," "drive rearward," "drive left," or "drive right" selections are inputted in conjunction therewith. In other embodiments, the controller 102 may actuate the base wheel drive 90 and/or the motion control device 82 to adjust the speed of the patient transport apparatus 30 based on current direction without active input from the operator input device 82. It is contemplated that the operator input device 100 and the controller 102 can be configured to control the speed and direction of the patient transport apparatus 30 in various other suitable configurations.

FIGS. 8A-19 illustrate multiple embodiments of the patient transport apparatus having one or more omni-directional wheels arranged in various configurations and coupled to various portions of the support structure of the patient transport apparatus.

Figure 8A:
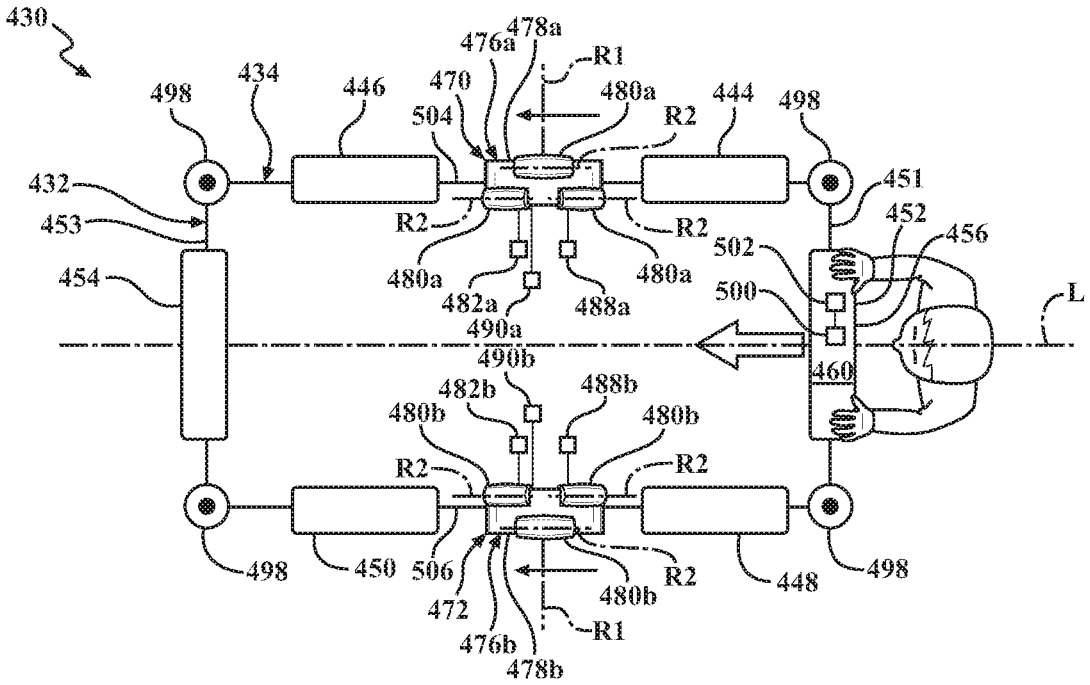
FIG. 8A is a schematic illustration of the operator pushing on a headboard to move another embodiment of a patient transport apparatus that has two opposing sides and two omni-directional wheels coupled to those sides.
Figure 8B:
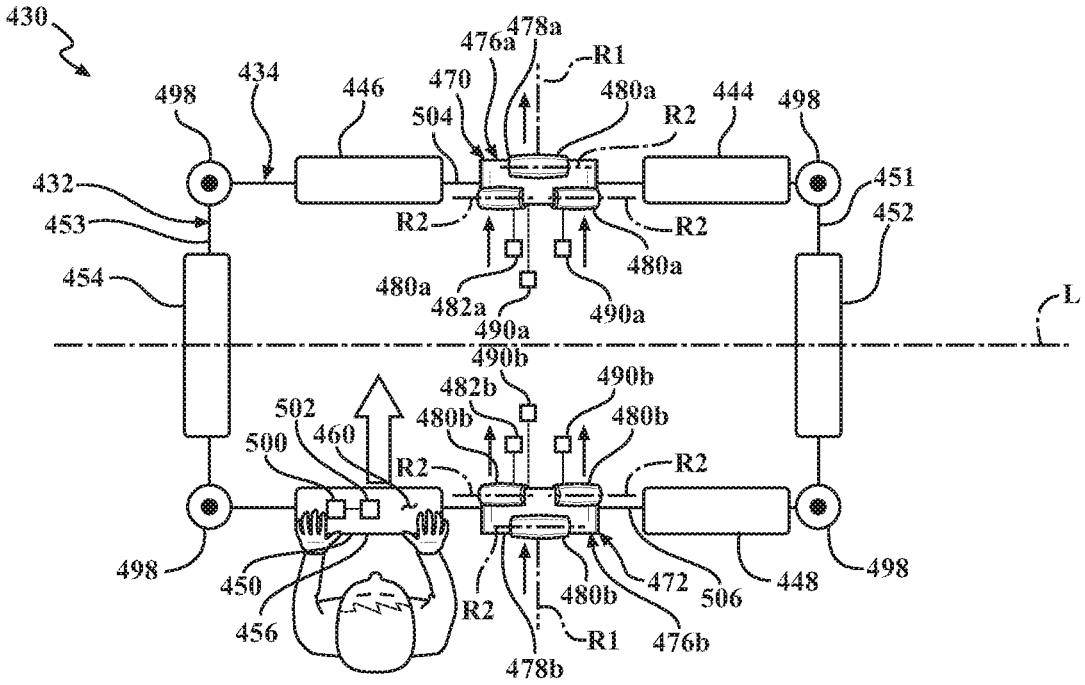
FIG. 8B is a schematic illustration of the operator pushing on a side rail to move the patient transport apparatus of FIG. 8A.

Referring to FIGS. 8A and 8B, another embodiment of the patient transport apparatus 430 is similar to the patient transport apparatus 30 of FIGS. 7A and 7B, and it comprises similar components identified by the same reference numbers increased by 400. However, while the patient transport apparatus 30 of FIGS. 7A and 7B has a single omni-directional wheel 70 coupled to a cross member 68, the patient transport apparatus 430 has two omni-directional wheels 470, 472 rotatably coupled to opposing sides 504, 506 of the base 434 about two base rotational axes R1 that are collinear with one another and perpendicular to the longitudinal axis L of the patient transport apparatus 430. Put another way, the two omni-directional wheels 470, 472 are rotatably coupled to opposing sides 504, 506 of the base 434 about a common base rotational axis R1.

Each omni-directional wheel 470, 472 is similar to the omni-directional wheel 70 of FIGS. 7A and 7B, which has a base wheel 76 and peripheral wheels 80 coupled to the outer periphery 78 of the base wheel 76. In particular, the first and second omni-directional wheels 470, 472 include base wheels 476*a*, 476*b* having outer peripheries 478*a*, 478*b*. The base wheels 476*a*, 476*b* are rotatably coupled to the support structure 432 about a common rotational axis R1 that is perpendicular to the longitudinal axis L of the patient transport apparatus 430. The omni-directional wheels 470, 472 comprise peripheral wheels 480*a*, 480*b* disposed about the outer peripheries 478*a*, 478*b* to rotate about peripheral rotational axes R2. In addition, the omni-directional wheels 470, 472 comprise motion control devices 482*a*, 482*b* configured to selectively control rotation of the corresponding peripheral wheels 480*a*, 480*b* independent of the rotation of the base wheels 476*a*, 476*b*, as previously described.

In FIG. 8A, the operator can input a "drive forward" selection into the operator input device 500, which generates an input signal and transmits the same to the controller 502. The controller 502 may then actuate the two omni-directional wheels 470, 472 for moving the patient transport apparatus 430 in the forward direction in the same manner that the controller 102 of FIG. 7A actuates the single omni-directional wheel 70 for moving the patient transport apparatus 30 in the forward direction along, for example, a long hallway. In particular, the "drive forward" selection can be inputted into the operator input device 500 to generate and transmit signals to the controller 502, which in turn places the motion control devices 482*a*, 482*b* in the braked mode to inhibit rotation of the peripheral wheels 480*a*, 480*b* and prevent corresponding movement of the patient transport apparatus 430 in the left/right directions. In addition, the controller 502 places the base brakes 488*a*, 488*b* in the unbraked mode to permit the base wheels 476*a*, 476*b* to freely rotate and permit movement of the patient transport apparatus 430 in the forward direction. The "drive forward" selection can also generate a signal transmitted from the operator input device 500 to the controller 502, which in turn actuates the base wheel drives 490*a*, 490*b* for rotating the base wheels 476*a*, 476*b* in a direction that moves the patient transport apparatus 430 in the forward direction with the footboard 454 leading. The operator can grasp the manual steering interface 456 to apply a torque to steer the patient transport apparatus 430 and/or direct movement of the patient transport apparatus 430. It is contemplated that the controller 502 may actuate the two omni-directional wheels 470, 472 to move the patient transport apparatus 430 in the opposite direction in the same manner that the controller 102 of FIG. 7A actuates the single omni-directional wheel 70 to move the patient transport apparatus 30 in the rearward direction in the "drive rearward" configuration.

In FIG. 8B, the operator can input a "drive right" selection into the operator input device 500, which generates an input signal and transmits the same to the controller 502. The controller 502 may in turn actuate the two omni-directional wheels 470, 472 to move the patient transport apparatus 430 in the right direction in the same manner that the controller 102 of FIG. 7B actuates the single omni-directional wheel 70 to move the patient transport apparatus 30 in the right direction when, for example, the patient transport apparatus 430 is being parked in a hospital room or shifted to the side in an elevator. In particular, the "drive right" selection can generate signals transmitted from the operator input device 500 to the controller 502, which in turn actuates the brakes 488*a*, 488*b* to inhibit rotation of the base wheel 476*a*, 476*b* and prevent corresponding movement of the patient transport apparatus 430 in the forward/rearward directions. The controller 502 also places the motion control devices 482*a*, 482*b* in the unbraked mode to permit the peripheral wheels 480 to freely rotate and permit movement of the patient transport apparatus 430 in the left/right directions. The "drive right" selection also generates a signal transmitted from the operator input device 500 to the controller 502, which in turn actuates the motion control devices 482*a*, 482*b* to rotate the peripheral wheels 480*a*, 480*b* in a direction that moves the patient transport apparatus 430 in the right direction. The operator can grasp the manual steering interface 456 to facilitate steering the patient transport apparatus 430 when the direction in which the patient transport apparatus 430 was originally pointed has been inadvertently changed. It is contemplated that the controller 502 may actuate the two omni-directional wheels 470, 472 to move the patient transport apparatus 430 in the opposite direction in the same manner that the controller 102 actuates the single omni-directional wheel 70 to move the patient transport apparatus 30 toward the left in the "drive left" configuration. Other mobility configurations in any direction and associated inputs are also contemplated.

Figure 9:
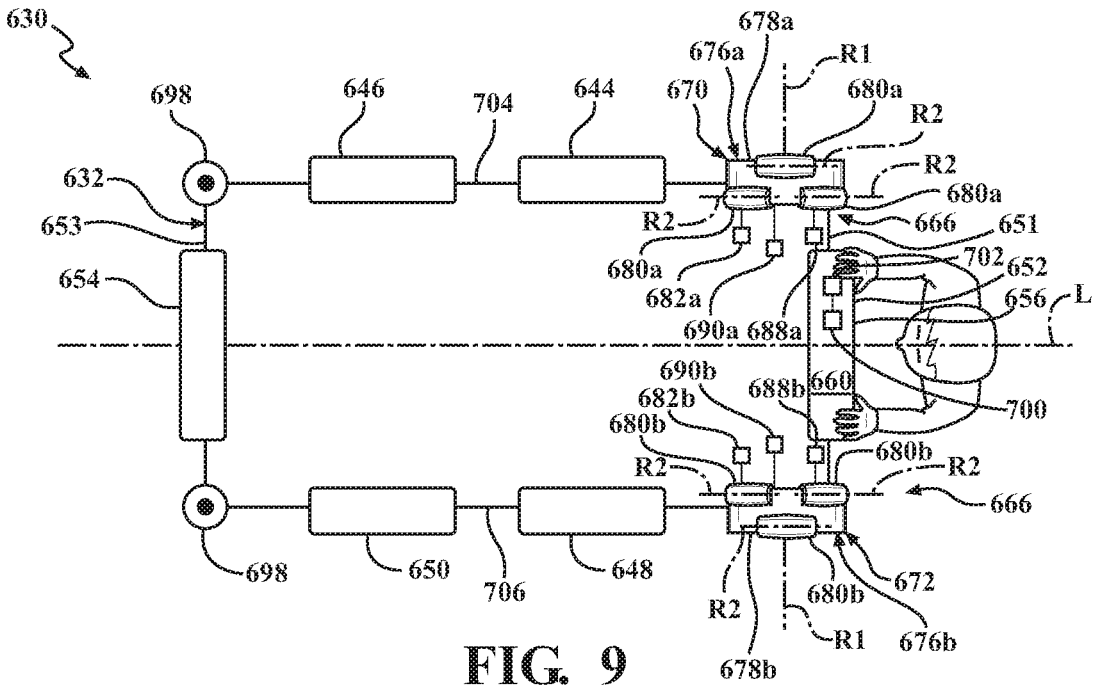
FIG. 9 is a schematic illustration of yet another embodiment of a patient transport apparatus showing the patient transport apparatus with two omni-directional wheels coupled to two corner portions.

FIG. 9 illustrates another embodiment of a patient transport apparatus 630, which is similar to the patient transport apparatus 430 of FIG. 8A, and it comprises similar components identified by the same reference numbers increased by 200. However, while the patient transport apparatus 430 of FIG. 8A comprises two omni-directional wheels 470, 472 rotatably coupled to the base 434 between the head and foot ends, on opposing left and right sides 504, 506 of the same, the patient transport apparatus 630 comprises two omni-directional wheels 670, 672 coupled to the corner portions 666 of the base 634 adjacent to the headboard 652. More specifically, the two omni-directional wheels 670, 672 include two base wheels 676*a*, 676*b* rotatably coupled to the corner portions 666 about two base rotational axes R1 that are collinear with one another and perpendicular to the longitudinal axis L of the patient transport apparatus 630. Put another way, the two omni-directional wheels 670, 672 are rotatably coupled to the corner portions 666 of the base 634 about a common rotational axis. It is contemplated that the patient transport apparatus 630 may operate in the same manner as the patient transport apparatus 430 illustrated in FIGS. 8A and 8B.

Figure 10:
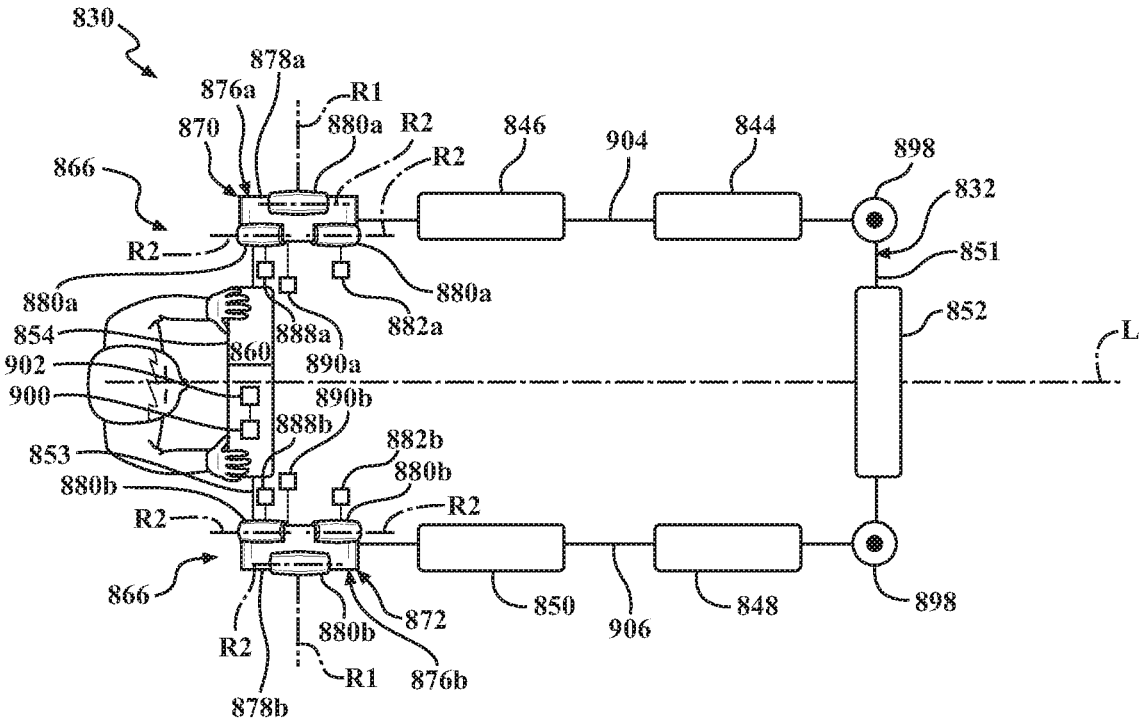
FIG. 10 is a schematic illustration of still another embodiment of a patient transport apparatus showing the patient transport apparatus with two omni-directional wheels coupled to two corner portions.

FIG. 10 illustrates still another embodiment of a patient transport apparatus 830, which is similar to the patient transport apparatus 430 of FIG. 8A and comprises similar components identified by the same reference numbers increased by 400. However, while the patient transport apparatus 430 of FIG. 8A comprises two omni-directional wheels 470, 472 rotatably coupled to the base 434 between the head and foot ends, on opposing left and right sides 504, 506 of the same, the patient transport apparatus 830 comprises two omni-directional wheels 870, 872 coupled to corner portions 866 of the base 834 adjacent to the footboard 854. In particular, the two omni-directional wheels 870, 872 include two base wheels 876*a*, 876*b* rotatably coupled to the two corner portions 866 about two base rotational axes R1 that are collinear with one another and perpendicular to the longitudinal axis L of the patient transport apparatus 830. Put another way, the two omni-directional wheels 870, 872 are rotatably coupled to the corner portions 866 of the base 834 about a common rotational axis. It is contemplated that the patient transport apparatus 830 may operate in the same manner as the patient transport apparatus 430 illustrated in FIGS. 8A and 8B.

Figure 11:
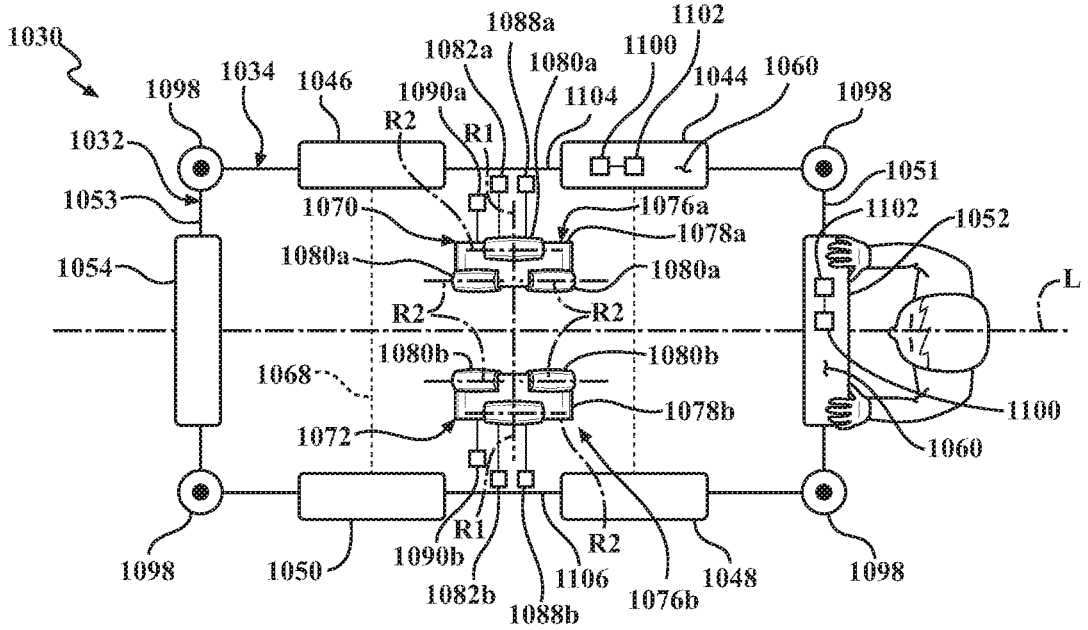
FIG. 11 is a schematic illustration of another embodiment of a patient transport apparatus showing the patient transport apparatus having a center portion and two omni-directional wheels rotatably coupled to the center portion about a common axis.

FIG. 11 illustrates yet another embodiment of a patient transport apparatus 1030, which is similar to the patient transport apparatus 430 of FIG. 8A and comprises similar components identified by the same reference numbers increased by 600. However, while the patient transport apparatus 430 of FIG. 8A comprises two omni-directional wheels 470, 472 rotatably coupled to the base 434 between the head and foot ends on opposing left and right sides 504, 506 of the same, the patient transport apparatus 1030 comprises two omni-directional wheels 1070, 1072 having two base wheels 1076*a*, 1076*b* spaced inwardly from the opposing left and right sides 1104, 1106 of the base 1034. The base wheels 1076*a*, 1076*b* may be rotatably coupled to the cross member 1068 about two base rotational axes R1 that are collinear with one another and perpendicular to the longitudinal axis L of the patient transport apparatus 830. Put another way, the two omni-directional wheels 1070, 1072 are rotatably coupled to the cross member 1068 of the base 1034 about a common rotational axis. It is contemplated that the patient transport apparatus 1030 may operate in the same manner as the patient transport apparatus 430 illustrated in FIGS. 8A and 8B.

Figure 12:
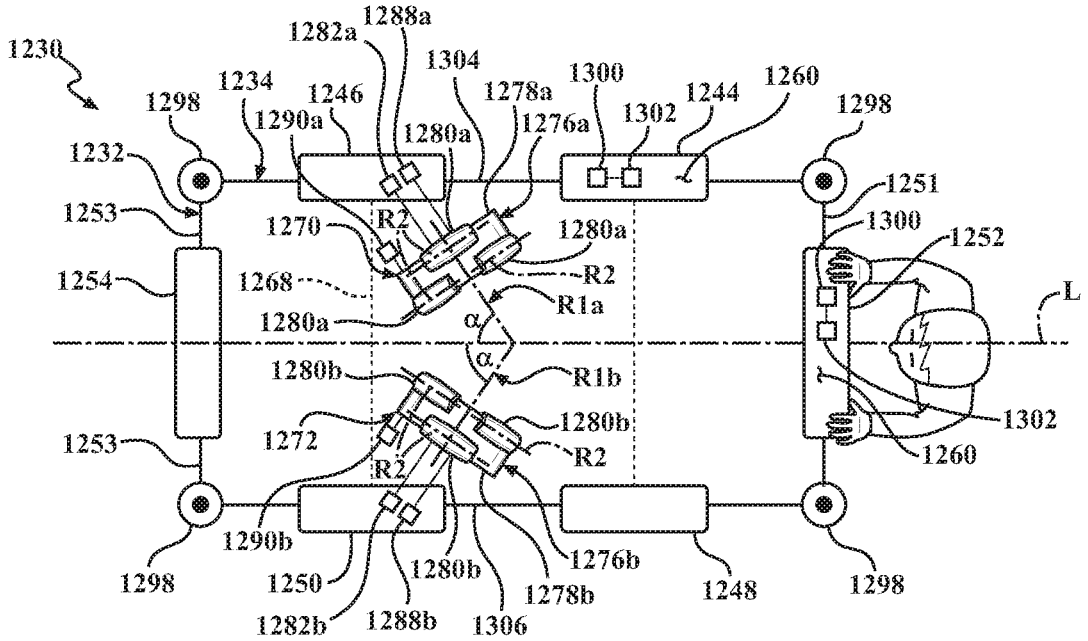
FIG. 12 is a schematic illustration of yet another embodiment of a patient transport apparatus showing two omni-directional wheels in a toe-in arrangement.

FIG. 12 illustrates yet another embodiment of a patient transport apparatus 1230, which is similar to the patient transport apparatus 30 of FIG. 7A and comprises similar components identified by the same reference numbers increased by 1200. However, while the patient transport apparatus 30 of FIG. 7A comprises the single omni-directional wheel 70 coupled to the cross member 68 of the base 34, the patient transport apparatus 1230 has two omni-directional wheels 1270, 1272 with two base wheels 1276*a*, 1276*b* arranged in a toe-in configuration toward the footboard 1254. In particular, the two base wheels 1276*a*, 1276*b* are rotatably coupled to a cross member 1268 about two base rotational axes R1*a*, R1*b* that are transverse to the longitudinal axis L of the patient transport apparatus 1230, by a common acute angle α in opposite directions from the axis L. Put another way, the two base rotational axes R1*a*, R1*b* converge toward the head end 1251 of the support structure 1232 and intersect one another at a common point along the longitudinal axis L. In the illustrated embodiment, the base wheels 1276*a*, 1276*b* are rotatably coupled to the cross member 1268 about two base rotational axes R1*a*, R1*b* that are transverse to the longitudinal axis L by 45 degrees and −45 degrees, respectively. Other common angles or distinct angles are contemplated. As but one example, one of the first and second omni-directional wheels may have a base rotational axis perpendicular to the longitudinal axis and be configured as the driving wheel, and the other of the first and second omni-directional wheels may have a base rotational axis that is parallel with the longitudinal axis and be configured as the steering wheel whereby activing driving of the steering wheel causes left/right motion to steer while the driving wheel causes forward/rearward motion. The driving wheel and/or the steering wheel can be manually controlled by an operator using an operator input, or can be automatically controlled.

Figure 13A:
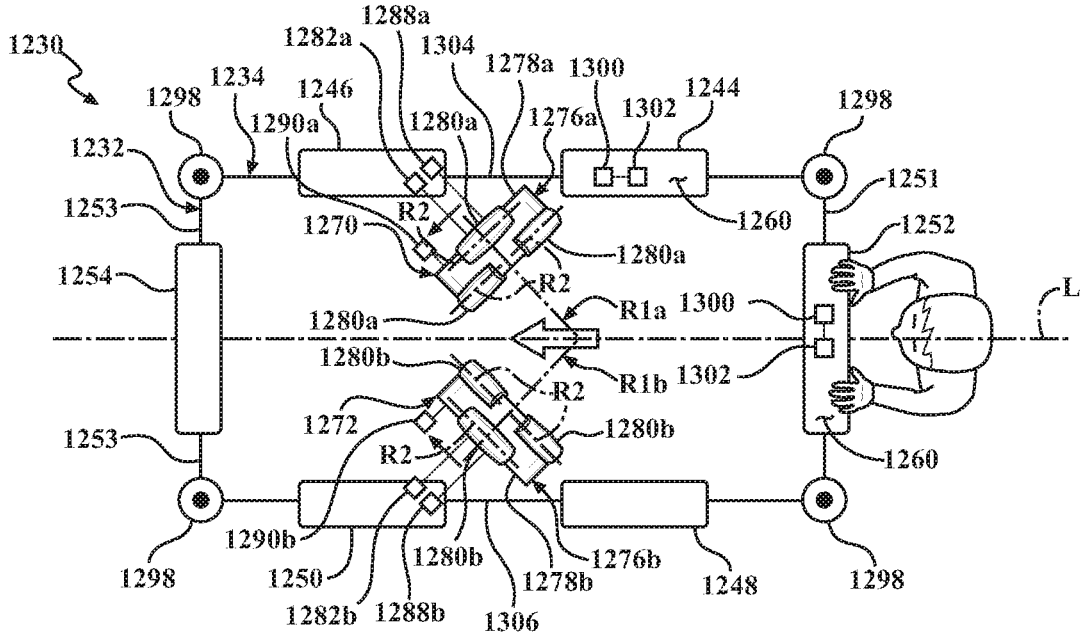
FIG. 13A is a schematic illustration of the two wheel assemblies of FIG. 12 showing movement of the patient transport apparatus in a forward direction parallel to the longitudinal axis.
Figure 13B:
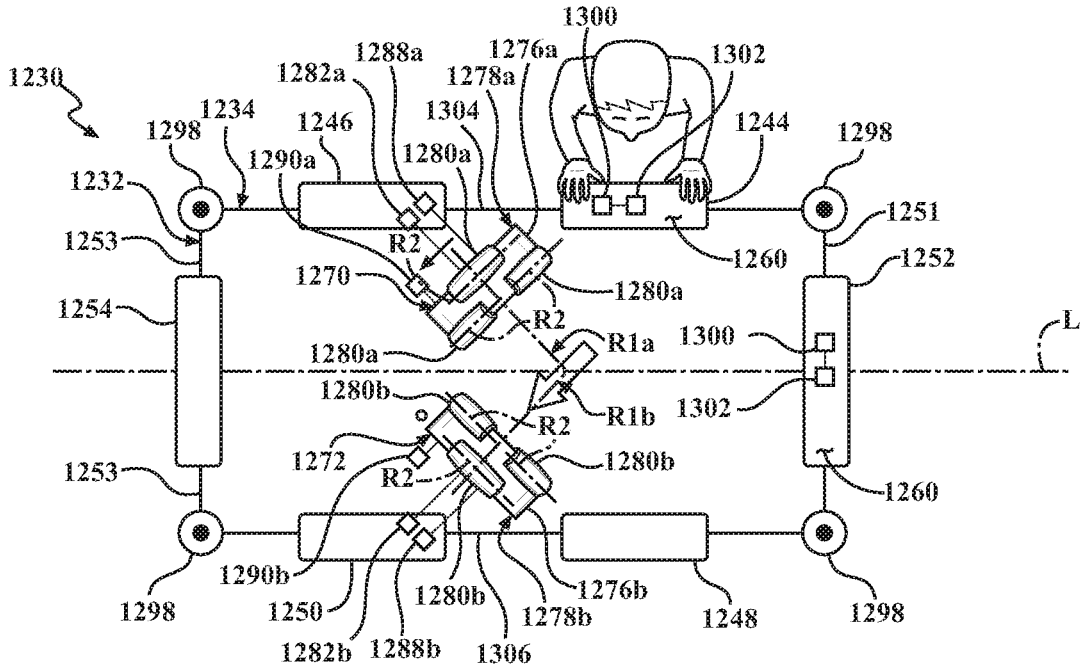
FIG. 13B is a schematic illustration of the two wheel assemblies of FIG. 12 showing movement of the patient transport apparatus in a direction transverse to the longitudinal axis.
Figure 13C:
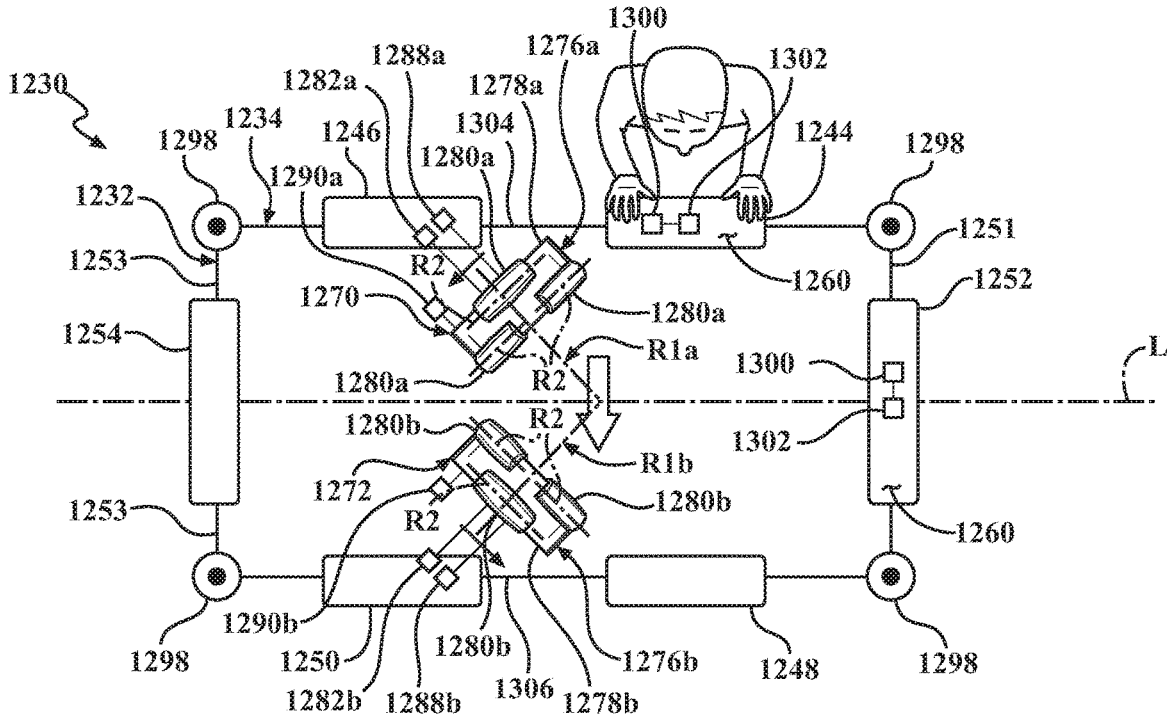
FIG. 13C is a schematic illustration of the two wheel assemblies of FIG. 12 showing movement of the patient transport apparatus in a lateral direction perpendicular to the longitudinal axis.

FIGS. 13A-13C illustrate rotation of the two omni-directional wheels 1270, 1272 of FIG. 12 for moving the patient transport apparatus 1230 in a forward direction parallel with the longitudinal axis L, a direction transverse to the longitudinal axis L, and a lateral direction perpendicular to the longitudinal axis L. The omni-directional wheels 1270, 1272 have base wheel drives 1290*a*, 1290*b* and motion control elements 1282*a*, 1282*b*, such that each one of the omni-directional wheels 1270, 1272 can be selectively configured as a driving wheel and/or a steering wheel. In FIG. 13A, the controller 1302 may be configured to actuate the base wheel drives 1290*a*, 1290*b* to rotate the base wheels 1276*a*, 1276*b* in a forward trajectory relative to the footboard 1254 such that the patient transport apparatus 1230 moves in a forward longitudinal direction that is parallel with the longitudinal axis L of the patient transport apparatus 30 (as indicated by the motion arrow). The controller 1302 may be configured to actuate the motion control elements 1282*a*, 1282*b* to rotate the peripheral wheels 1280*a*, 1280*b* in a forward trajectory relative to the footboard 1254 and compensate for the radially inward travel associated with the rotation of the corresponding base wheels 1276*a*, 1276*b*. Of course, it is contemplated that the controller 1302 may be configured to actuate the motion control elements 1282*a*, 1282*b* to inhibit rotation of the peripheral wheels 1280*a*, 1280*b*, allow partial rotation of the same, or the peripheral wheels 1280*a*, 1280*b* may freely rotate and merely act as followers.

FIG. 13B illustrates the controller 1302 being configured to actuate one of the base wheel drives 1290*a*, 1290*b* to rotate the base wheel 1276*a* in the forward trajectory relative to the footboard 1254, while not actively driving rotation of the other base wheel 1276*b*, permitting free rotation of the base wheel 1276*b*, actively driving the other base wheel 1276*b* at a slower rotational speed, or while inhibiting rotation of the other base wheel 1276*b* (e.g., via the base brake 1288*a* or 1288*b*) such that the patient transport apparatus 1230 moves in a direction that is transverse to the longitudinal axis L of the support structure 1232 (as indicated by the motion arrow). Furthermore, the controller 1302 may be configured to actuate the motion control element 1282*b* to rotate the peripheral wheels 1280*b* in the direction transverse to the longitudinal axis L and/or actuate the motion control element 1282*a* to brake, lock or otherwise inhibit rotation of the peripheral wheels 1280*a*. In other embodiments, the controller may move the base wheel

1276*b* to a retracted position such that the base wheel 1276*b* is spaced above the floor surface as exemplified in FIG. 6. Of course, it is contemplated that the controller 1302 may be configured to actuate any of the motion control elements 1282*a*, 1282*b* to control rotation of the peripheral wheels 1280*a*, 1280*b* in any direction and in any manner.

FIG. 13C shows the controller 1302 being configured to actuate the base wheel drives 1290*a*, 1290*b* to rotate the base wheel 1276*a* in the forward trajectory relative to the footboard 1254 and rotate the other base wheel 1276*b* in a rearward trajectory relative to the footboard 1254 such that the patient transport apparatus 1230 moves in a lateral direction that is perpendicular to the longitudinal axis L of the patient transport apparatus 1230. The controller 1302 may be configured to actuate the motion control elements 1282*a* to rotate the peripheral wheels 1280*a* in a rearward trajectory relative to the headboard 1252 and actuate the motion control elements 1282*b* to rotate the peripheral wheels 1280*b* in a forward trajectory relative to the footboard 1254, such that the peripheral wheels 1280*a*, 1280*b* can move the patient transport apparatus 1230 in the lateral direction that is perpendicular to the longitudinal axis L and compensate for the forward and rearward movement associated with rotation of the base wheels 1276*a*, 1276*b*. Of course, it is contemplated that controller 1302 may be configured to actuate the motion control elements 1282*a*, 1282*b* to inhibit rotation of the peripheral wheels 1280*a*, 1280*b* in a rearward trajectory toward the headboard 1252, allow only partial rotation of the peripheral wheels 1280*a*, 1280*b*, or the peripheral wheels 1280*a*, 1280*b* may freely rotate and merely act as followers.

Figure 14:
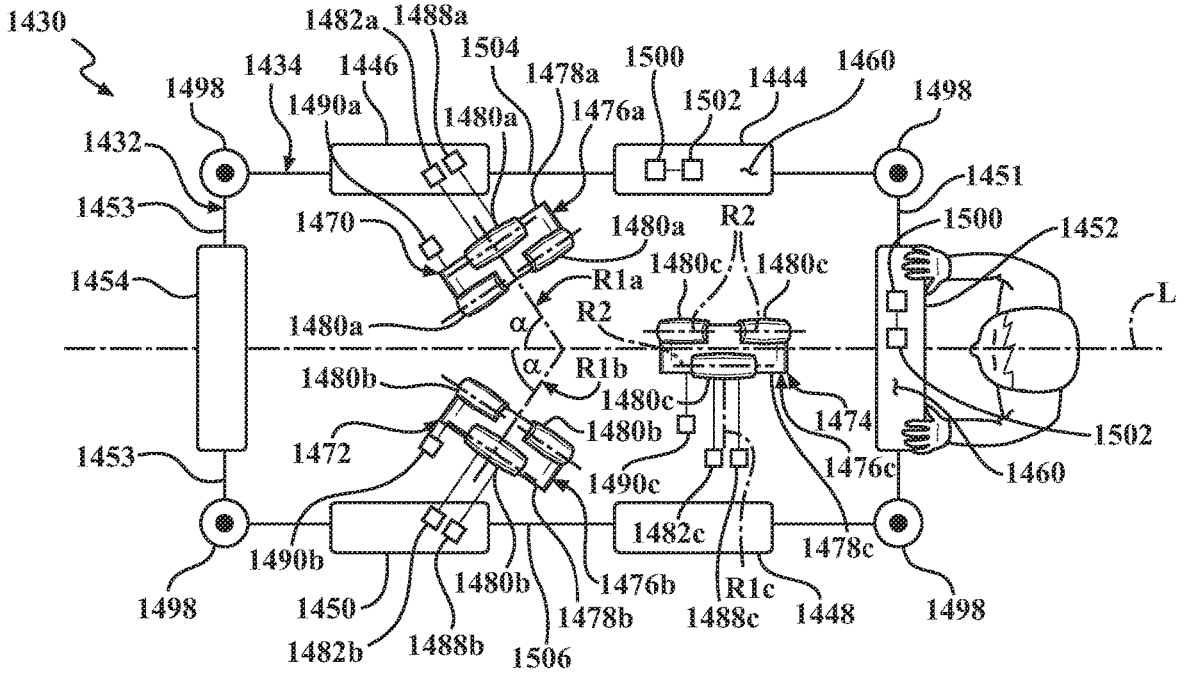
FIG. 14 is a schematic illustration of another embodiment of a patient transport apparatus having a third omni-directional wheel that has a base rotational axis that is perpendicular to the longitudinal axis.

FIG. 14 illustrates another embodiment of a patient transport apparatus 1430 that is similar to the patient transport apparatus 1230 of FIGS. 12-13C, and it comprises the same components identified by reference numbers increased by 200. However, while the patient transport apparatus 1200 of FIGS. 12-13C comprises two omni-directional wheels 1270, 1272, the patient transport apparatus 1430 comprises three omni-directional wheels 1470, 1472, 1474. Omni-directional wheels 1470, 1472 are substantially similar to the omni-directional wheels 1270, 1272 of FIGS. 12-13C. The third omni-directional wheel 1474 may be configured as the driving wheel, and the first and second omni-directional wheels 1470, 1472 may be configured as the steering wheels, for moving the patient transport apparatus in desired directions. More specifically, the first and second omni-directional wheels 1470, 1472 may be used to provide directional control (e.g., steering, slew, lateral control) based on their respective rates of rotation compared to one other and the third omni-directional wheel 1474. The base wheel drive 1490*c* (e.g., including the motor), for the third omni-directional wheel 1474 can be larger and more powerful than the base wheel drives 1490*a*, 1490*b* (e.g., including the motors), for the first and second omni-directional wheels 1470,1472. It is contemplated that the base wheel drives for the three omni-directional wheels 1470, 1472, 1474 can have the same size and/or power. As but one example, the third omni-directional wheel 1474 being configured as the driving wheel can be particularly useful for moving the patient along lengthy corridors having an incline.

The third omni-directional wheel 1474 comprises a third base wheel 1476*c* having a third outer periphery 1478*c* and rotatably coupled to the support structure 1432 about a third base rotational axis R1*c*. The third omni-directional wheel 1474 comprises peripheral wheels 1480*c* disposed about the third outer periphery 1478*c* to rotate about peripheral rotational axes R2. The third omni-directional wheel 1474 comprises one or more third motion control devices 1482*c* configured to selectively control rotation of the peripheral wheels 1480*c* independent of the rotation of the third base wheel 1476*c* about the third base rotational axis R1*c*, in the same manner as previously described. The third base rotational axis R1*c* is perpendicular to the longitudinal axis L. Other third wheel assemblies are contemplated.

Figure 15A:
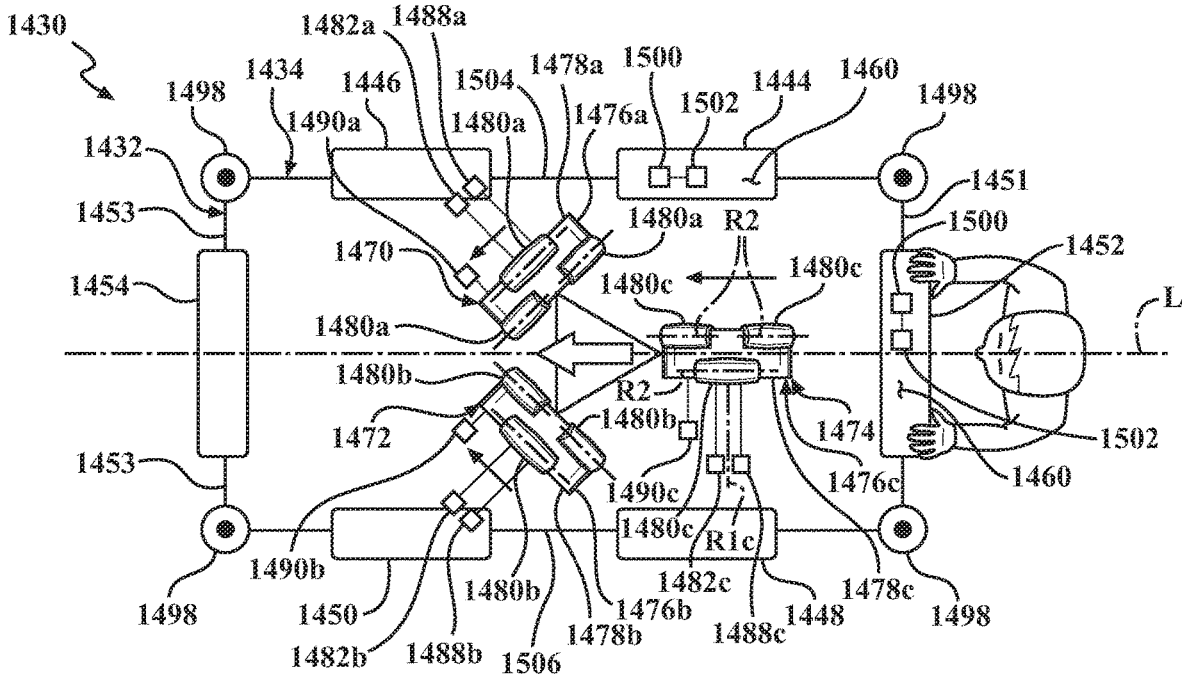
FIG. 15A is a schematic illustration of the three omni-directional wheels of FIG. 14 showing movement of the patient transport apparatus in a forward direction parallel to the longitudinal axis.
Figure 15B:
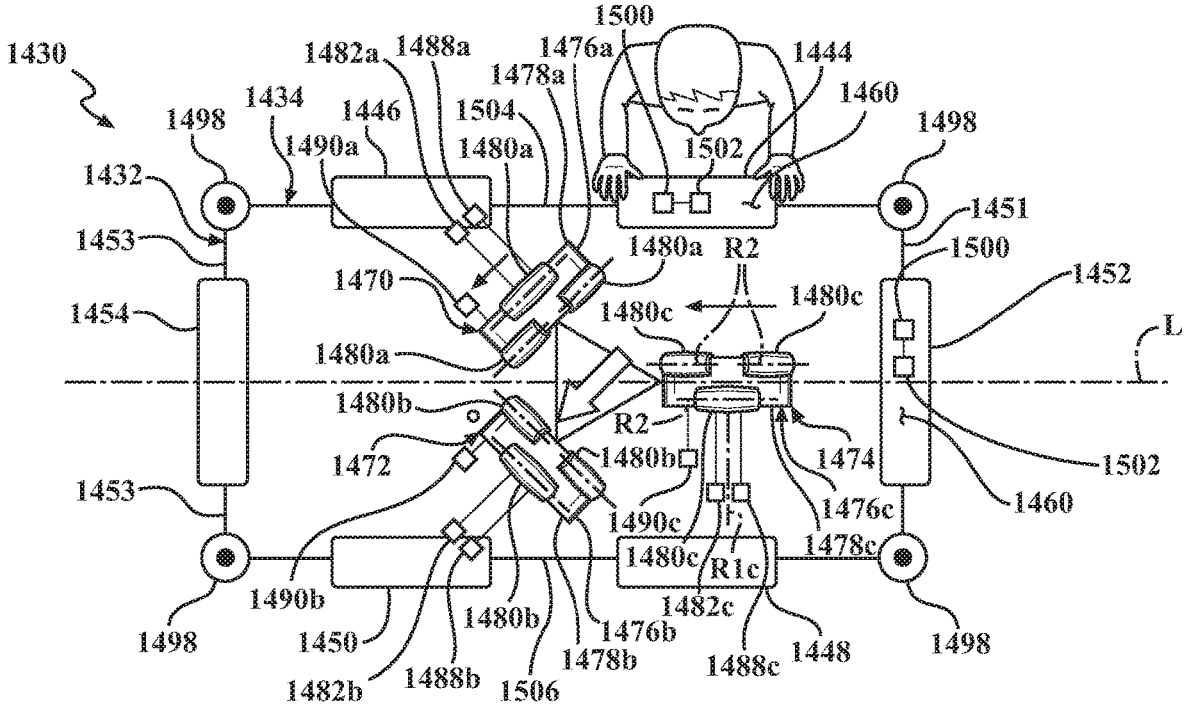
FIG. 15B is a schematic illustration of the three omni-directional wheels of FIG. 14 showing movement of the patient transport apparatus in a direction transverse to the longitudinal axis.
Figure 15C:
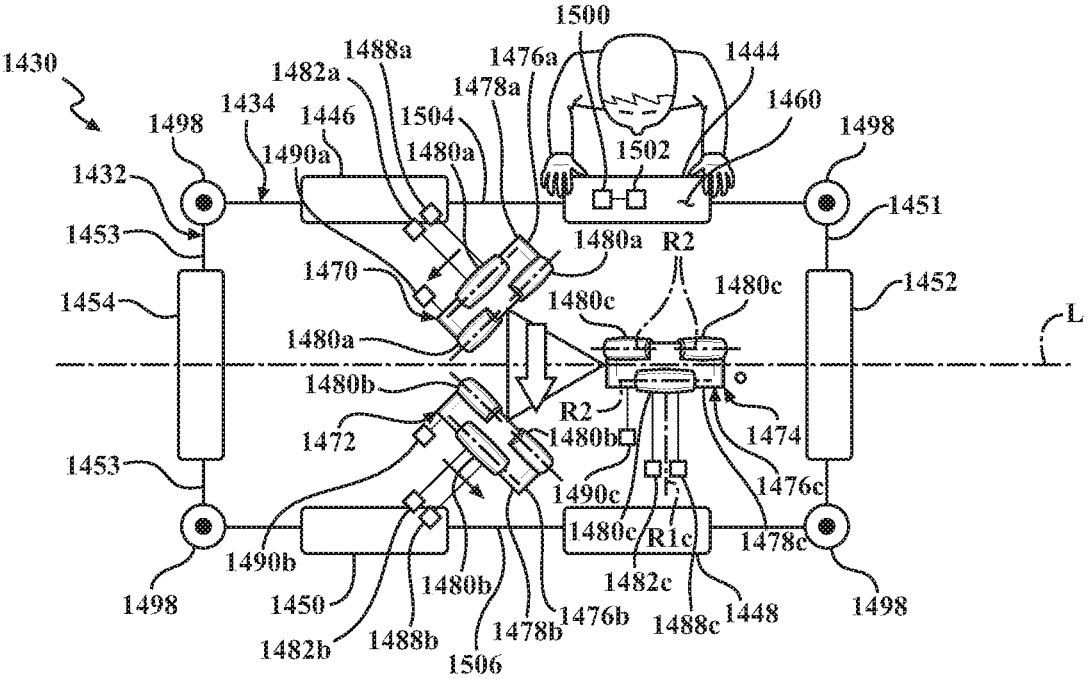
FIG. 15C is a schematic illustration of the three omni-directional wheels of FIG. 14 showing movement of the patient transport apparatus in a lateral direction perpendicular to the longitudinal axis.

FIGS. 15A-15C show rotation of the omni-directional wheels 1470, 1472, 1474 for moving the patient transport apparatus 1430 in a corresponding one of a forward direction parallel with the longitudinal axis L, a direction transverse to the longitudinal axis L, and a lateral direction perpendicular to the longitudinal axis L. These configurations are similar to the configurations shown in FIGS. 13A-13C. However, the patient transport apparatus 1430 comprises the third omni-directional wheel 1474 that can rotate and perform as the auxiliary drive wheel to facilitate moving the apparatus in the forward direction (FIG. 15A) and the direction transverse to the longitudinal axis L (FIG. 15B). When the operator intends to move the patient transport apparatus 1430 in the lateral direction, the controller 1502 can actuate a base brake 1488*c* of the third base wheel 1476*c* and actuate the motion control device 1482*c* to rotate one of the third peripheral wheels 1480*c*. Of course, other mobility configurations are contemplated. As but one example, in other embodiments, the controller 1502 may actuate the base wheel drive 1490*c* to rotate the base wheel 1476*c* in a forward trajectory relative to the footboard 1454 or a rearward trajectory relative to the footboard 1454. Still, in other embodiments, the controller 1502 may actuate the motion control device 1482*c* to rotate one of the third peripheral wheels 1480*c* toward the left side 1506 or the right side 1504 of the patient transport apparatus 1430 for lateral movement. The controller 1502 may actuate the base wheel drive 1490*c* to rotate the base wheel 1476*c* in a manner that assists with moving the patient transport apparatus 1430 in the intended direction or the controller 1502 may actuate the base wheel drive 1490*c* to rotate the base wheel 1476*c* in a manner that opposes the intended direction of movement of the patient transport apparatus 1430, thereby operating as a speed control mechanism to slow movement of the patient transport apparatus 1430. Similarly, the controller 1502 may actuate the motion control device 1482*c* to rotate one of the third peripheral wheels 1480*c* in a manner that assists with moving the patient transport apparatus 1430 in the intended direction or the controller 1502 may actuate the motion control device 1482*c* to rotate one of the third peripheral wheels 1480*c* in a manner that opposes the intended direction of movement of the patient transport apparatus 1430, thereby operating as a speed control mechanism to slow movement of the patient transport apparatus 1430.

Figure 16:
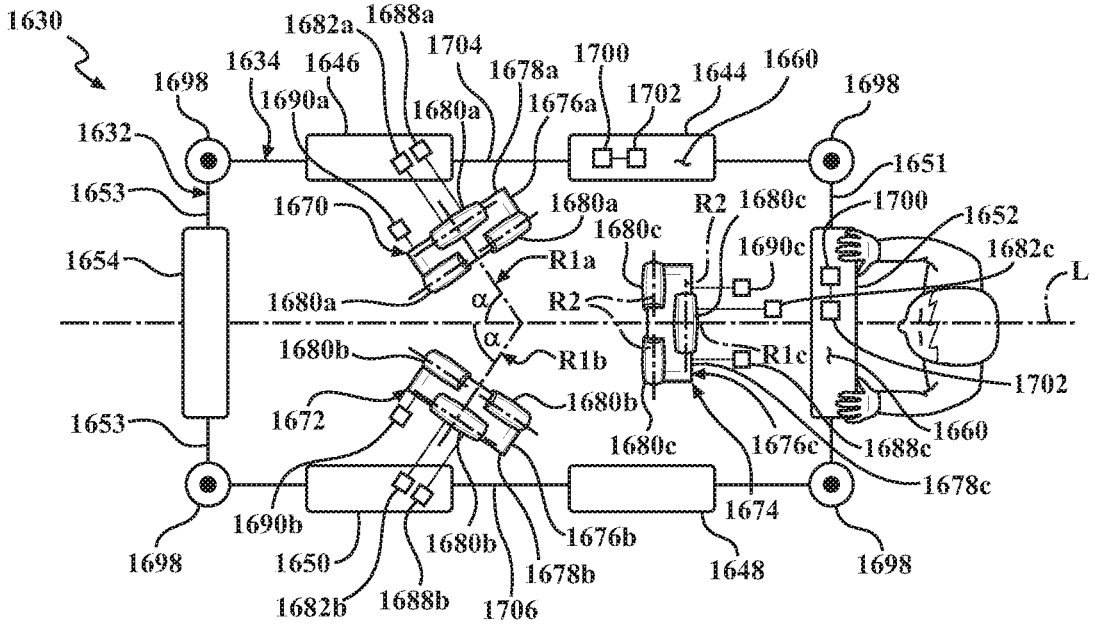
FIG. 16 is a schematic illustration of another embodiment of a patient transport apparatus showing the patient transport apparatus having a third wheel assembly that has a third base rotational axis that is parallel with the longitudinal axis.

FIG. 16 illustrates another embodiment of a patient transport apparatus 1630 that is similar to the patient transport apparatus 1430 illustrated in FIGS. 14-15C, and it comprises the same components identified by reference numbers increased by 200. However, while the third base wheel 1476*c* of FIGS. 14-15C is rotatably coupled to the support structure 1432 about a third base rotational axis R1*c* that is perpendicular to the longitudinal axis L, the third base wheel 1676*c* is rotatably coupled to the support structure 1432 about a third base rotational axis R1*c* that is parallel with the longitudinal axis L. In this embodiment, the third omni-directional wheel 1674 may be configured as the steering wheel. Each one of the first and second omni-directional wheels 1670, 1672 may be configured as a primary longitudinal driving wheel and/or an auxiliary steering wheel for moving the patient transport apparatus in desired directions. Other driving and/or steering wheel configurations are contemplated.

Figure 17:
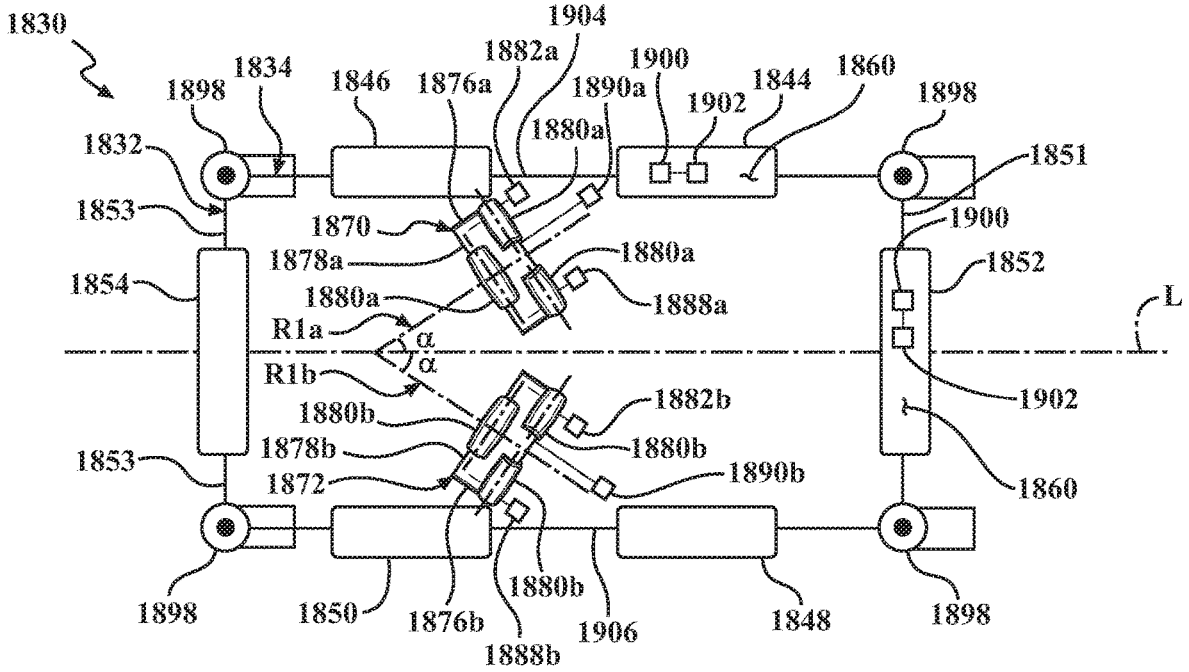
FIG. 17 is a schematic illustration of yet another embodiment of a patient transport apparatus showing two omni-directional wheels in a toe-out arrangement.
Figure 18:
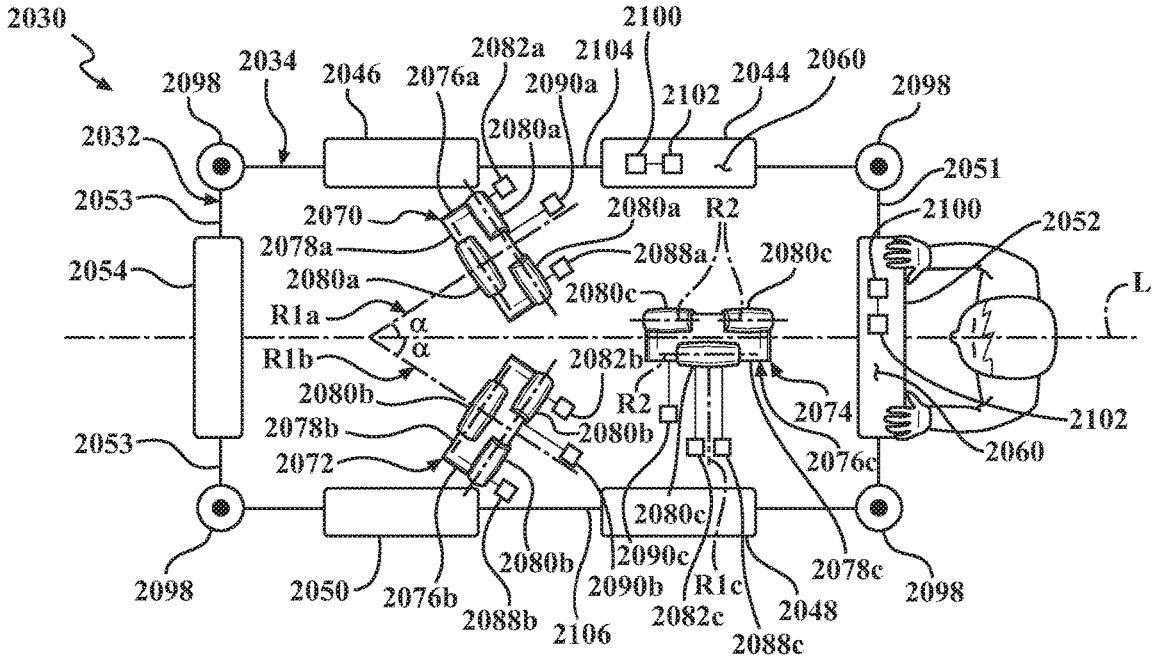
FIG. 18 is a schematic illustration of another embodiment of a patient transport apparatus comprising a third omni-directional wheel having a rotational axis perpendicular to the longitudinal axis of the patient transport apparatus.
Figure 19:
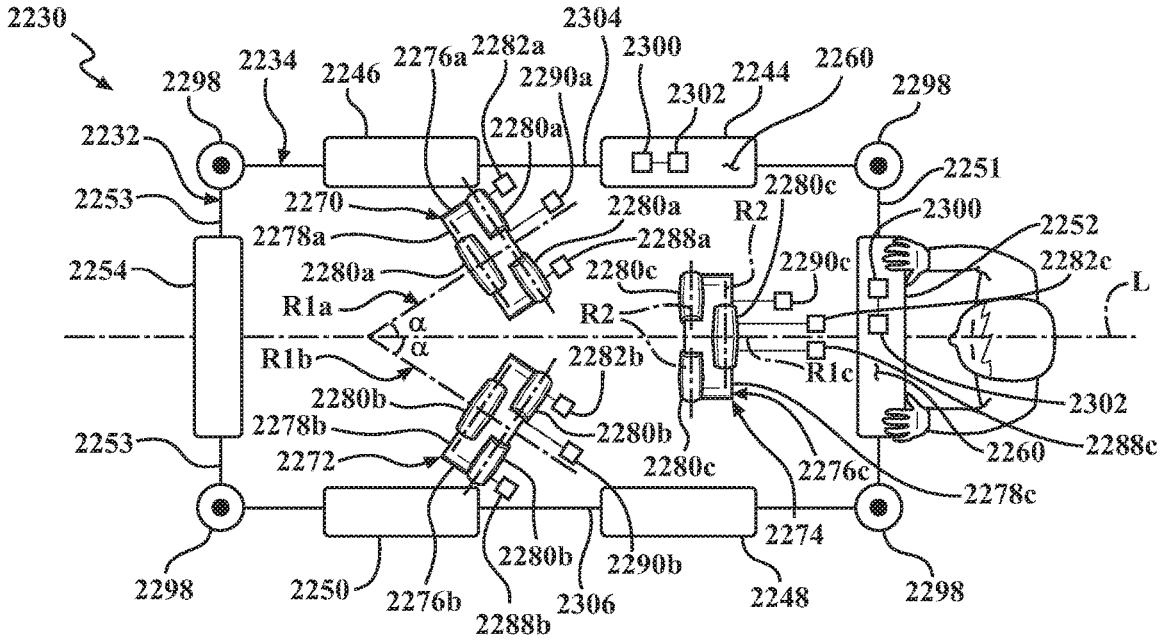
FIG. 19 is a schematic illustration of another embodiment of a patient transport apparatus comprising a third omni-directional wheel having a rotational axis parallel with the longitudinal axis of the patient transport apparatus.

FIGS. 17-19 show other embodiments of patient transport apparatuses 1830, 2030, 2230 that are similar to the patient transport apparatuses 1230, 1430, 1630 illustrated in FIGS. 12, 14, and 16 and include similar components identified by numbers increased by 600. However, while FIGS. 12, 14, and 16 show each patient transport apparatus 1230, 1430, 1630 having two forward wheel assemblies in a toe-in configuration toward the footboard 1254, 1454, 1654, each patient transport apparatus 1830, 2030, 2230 of FIGS. 17-19 comprises two forward wheel assemblies in a toe-out configuration relative to the footboard 1854, 2054, 2254.

More specifically, the base wheels 1276*a*, 1276*b* of FIG. 12 are rotatably coupled to the support structure 1232 about two base rotational axes that converge toward the head end portion 1251 of the support structure 1232. In contrast to the base wheels 1276*a*, 1276*b* of FIG. 12, the base wheels 1876*a*, 1876*b* of FIG. 17 are rotatably coupled to the support structure 1832 about two base rotational axes R1*a*, R1*b* that converge toward the foot end portion 1853 of the support structure 1832.

Similarly, while the base wheels 1476*a*, 1476*b* of FIG. 14 are rotatably coupled to the support structure 1432 about two base rotational axes R1*a*, R1*b* that converge toward the head end portion 1451 of the support structure 1432, the base wheels 2076*a*, 2076*b* of FIG. 18 are rotatably coupled to the support structure 2032 about two base rotational axes R1*a*, R1*b* that converge toward the foot end portion 2053 of the support structure 2032.

Moreover, while the base wheels 1676*a*, 1676*b* of FIG. 16 are rotatably coupled to the support structure 1632 about two base rotational axes R1*a*, R1*b* that converge toward the head end portion 1651 of the support structure 1632, the base wheels 2276*a*, 2276*b* of FIG. 19 are rotatably coupled to the support structure 2232 about two base rotational axes R1*a*, R1*b* that converge toward the foot end portion 2253 of the support structure 2232.

Figure 20:
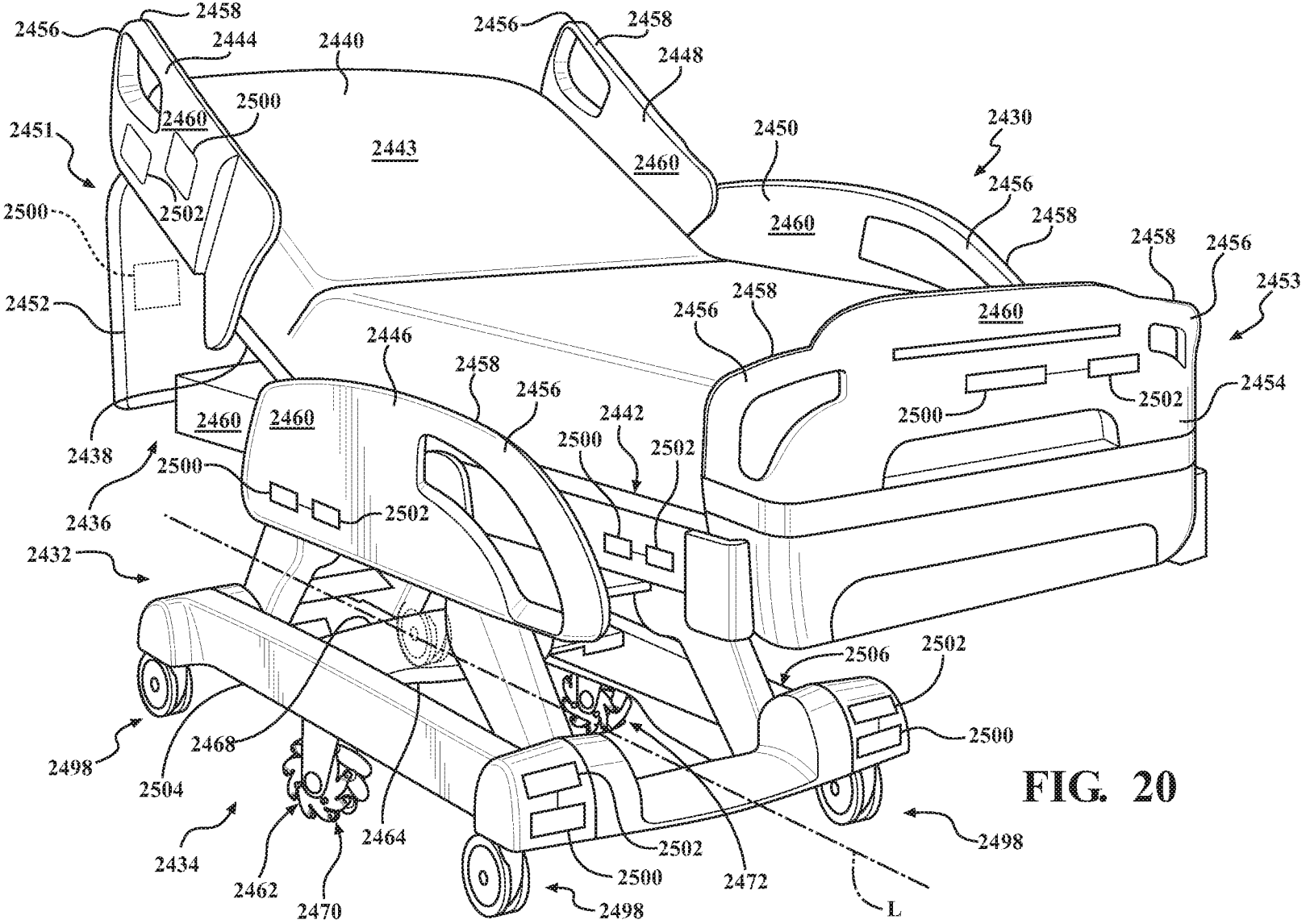
FIG. 20 is a perspective view of another embodiment of a patient transport apparatus having two wheel assemblies in the form of mecanum wheels.
Figure 21:
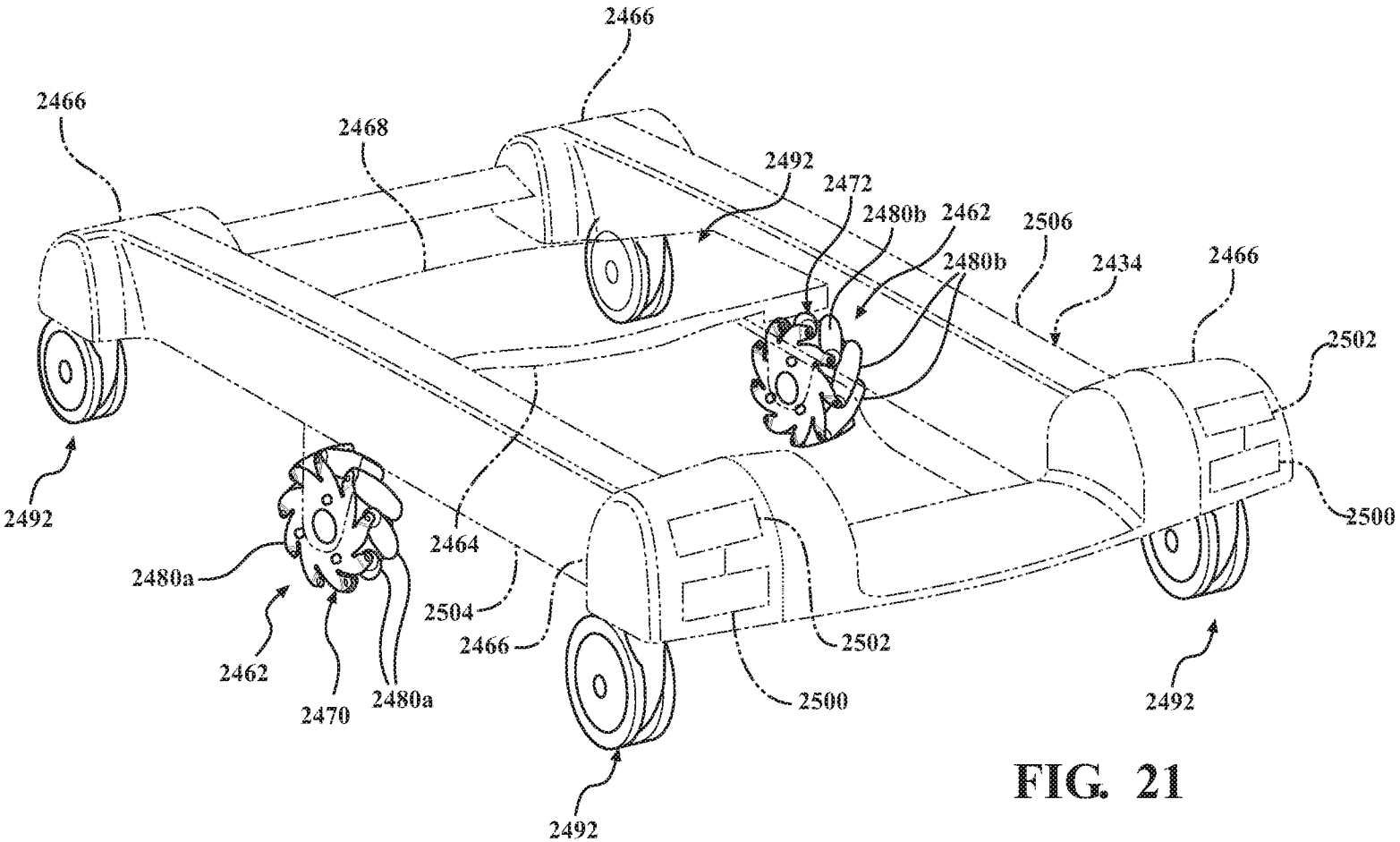
FIG. 21 is a schematic illustration of support wheels and the two mecanum wheels of FIG. 20.
Figure 22:
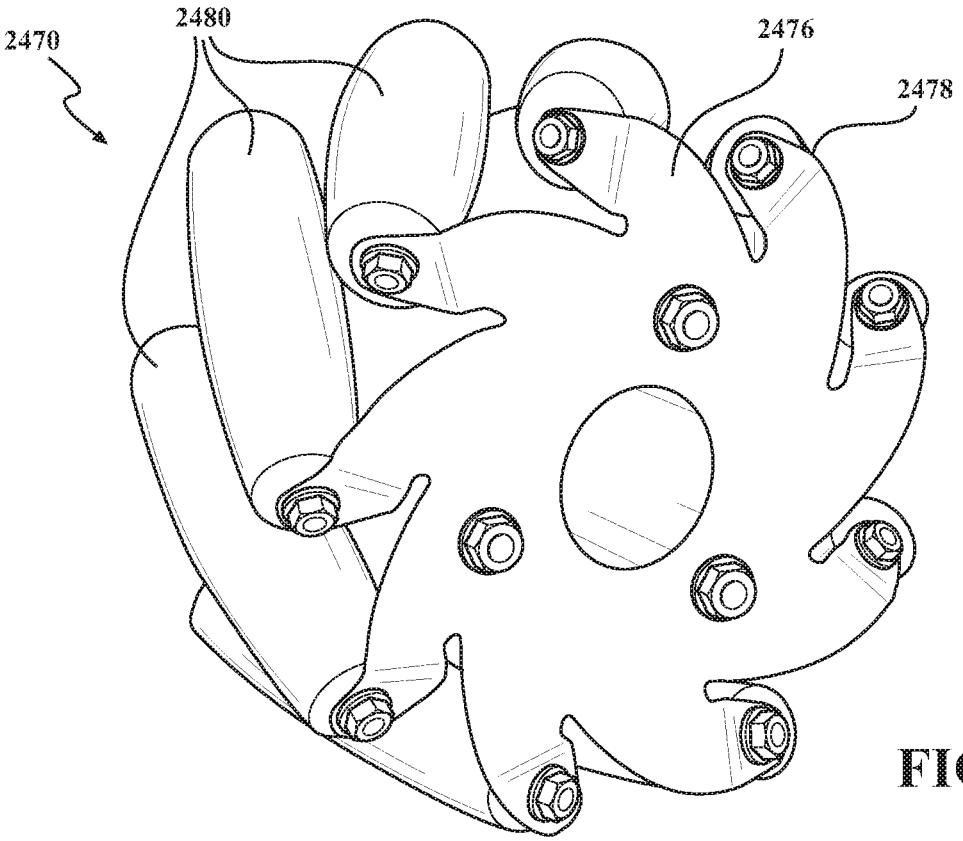
FIG. 22 is a perspective view of one of the mecanum wheels of FIG. 21 showing the wheel assembly having a base wheel and peripheral wheels.

Referring to FIGS. 20 and 21, still another embodiment of a patient transport apparatus 2430 is illustrated. The patient transport apparatus 2430 is similar to the patient transport apparatus 30 of FIG. 1 and comprises components identified by the same numbers increased by 2400. However, while patient transport apparatus 30 of FIG. 1 comprises a single omni-directional wheel 70 coupled to the cross member 68 of the base 34, the patient transport apparatus 2430 comprises two mecanum wheels 2470, 2472 coupled to opposing sides 2504, 2506 of the base 2434. Furthermore, while FIG. 22 illustrates the mecanum wheel 2470 and its arrangement of components, the mecanum wheels 2470, 2472 are similar to one another. In the illustrated embodiment, the mecanum wheels 2470, 2472 include base wheels 2476*a*, 2476*b* having outer peripheries 2478*a*, 2478*b* rotatably coupled to the support structure 2432 about base rotational axes that are collinear with one another such that the base wheels 2476 are rotatably coupled to the support structure 2432 about a common rotational axis that is perpendicular to the longitudinal axis L. In addition, the base wheel drives 2490*a*, 2490*b* include drive axles (not shown), which are perpendicular to the longitudinal axis L and coupled to a respective one of base wheels 2476*a*, 2476*b*. The mecanum wheels 2470, 2472 respectively comprise left and right handed peripheral wheels 2480*a*, 2480*b* positioned about the outer peripheries 2478*a*, 2478*b* to freely rotate about peripheral rotational axes. In this embodiment, the rotation of the peripheral wheels 2480*a*, 2480 are not driven or inhibited by any motion control element or other drive. However, the direction of rotation of the base wheels 2476*a*, 2476*b* and the position of the peripheral wheels 2480*a*, 2480*b* relative to the wheelbase diagonal are exemplified in the description for FIGS. 23A-30. Other embodiments of the patient transport apparatus having two or more mecanum wheels positioned in any configuration are contemplated.

Figure 23A:
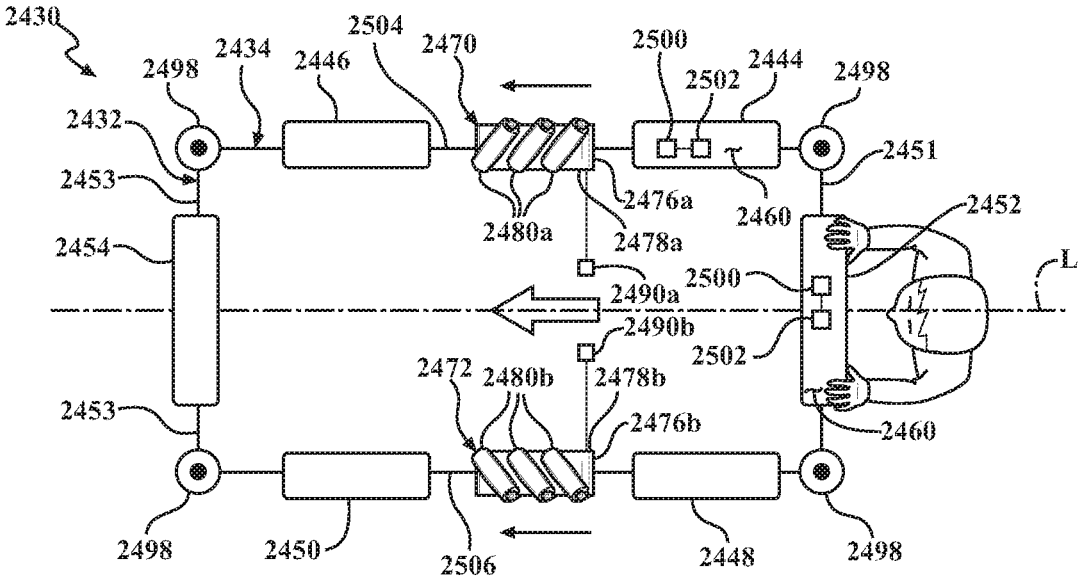
FIG. 23A is a schematic illustration of the two mecanum wheels of FIG. 20 showing movement of the patient transport apparatus in a forward direction parallel to the longitudinal axis.
Figure 23B:
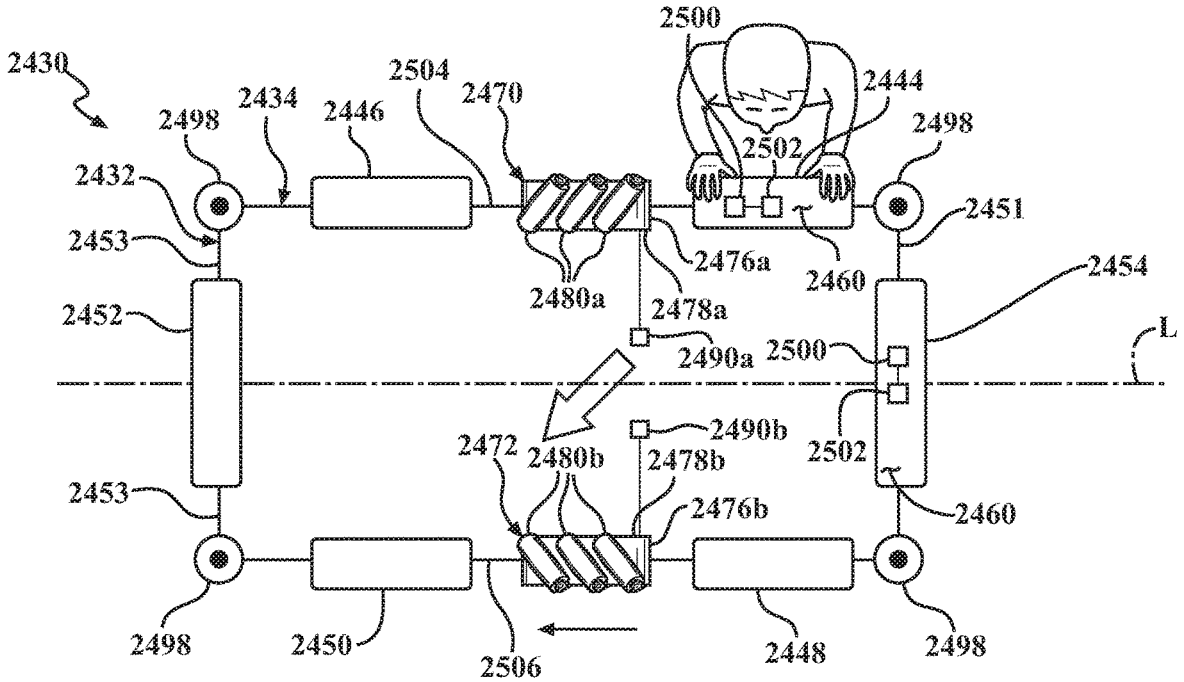
FIG. 23B is a schematic illustration of the two wheel assemblies of FIG. 23A showing movement of the patient transport apparatus in a direction transverse to the longitudinal axis.
Figure 23C:
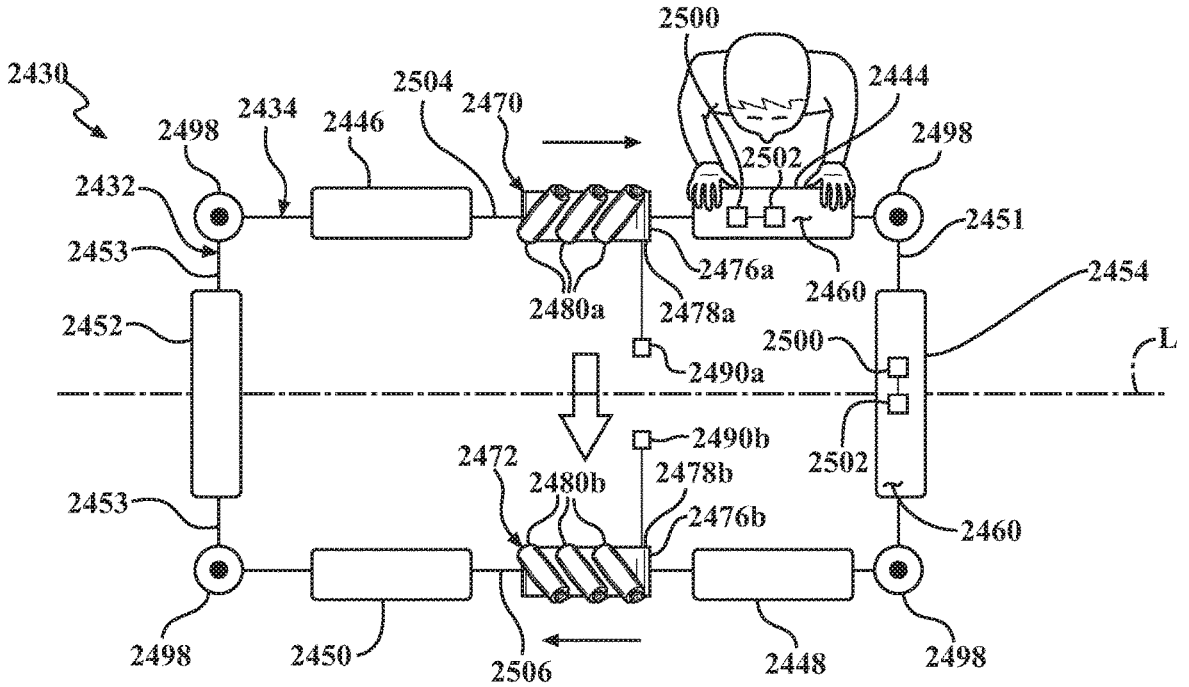
FIG. 23C is a schematic illustration of the two wheel assemblies of FIG. 23A showing movement of the patient transport apparatus in a lateral direction perpendicular to the longitudinal axis.

FIGS. 23A-23C illustrate rotation of the mecanum wheels 2470, 2472 for moving the patient transport apparatus 2430 in a forward direction parallel with the longitudinal axis L, a direction transverse to the longitudinal axis L, and a lateral direction perpendicular to the longitudinal axis L. In FIG. 23A, the controller 2502 is configured to actuate the base wheel drives 2490*a*, 2490*b* to rotate the base wheels 2476*a*, 2476*b* in a forward trajectory toward the footboard 2454 such that the patient transport apparatus 2430 moves in a forward direction that is parallel with said longitudinal axis L of the patient transport apparatus 2430. Moving the base wheels 2476*a*, 2476*b* in the same direction either forward or rearward relative to the footboard 2454 causes forward or rearward movement of the patient transport apparatus 2430. FIG. 23B illustrates the controller 2502 being configured to actuate the base wheel drives 2490*a*, 2490*b* to rotate the base wheel 2476*b* in the forward trajectory toward the footboard 2454 and inhibit rotation of the other base wheel 2476*a* such that the patient transport apparatus 2430 moves in a direction that is transverse to the longitudinal axis L of the support structure 2432. Rotating the base wheel 2476*b* on the left side 2506 in a forward trajectory relative to the footboard 2454 while not actively rotating, rotating at a slower rotational speed, or inhibiting rotation of the base wheel 2476*a*, causes diagonal movement of the patient transport apparatus 2430 in a forward-left diagonal direction along the rolling direction of the freely rotating peripheral wheels 2480*b*. It is contemplated that rotating the base wheel 2476*a* on the right side 2506 in a forward trajectory relative to the footboard 2454 while not actively rotating, more slowly rotating, or inhibiting rotation of the base wheel 2476*b*, causes diagonal movement of the patient transport apparatus 2430 in a forward-right diagonal direction along the rolling direction of the freely rotating peripheral wheels 2480*a*. FIG. 23C shows the controller 2502 being configured to actuate the base wheel drives 2490*a*, 2490*b* to rotate the base wheel 2476*a* in the forward trajectory toward the footboard 2454 and rotate the other base wheel 2476*b* in a rearward trajectory toward the headboard 2452 such that the patient transport apparatus 2430 moves in a lateral direction that is perpendicular to the longitudinal axis L of the patient transport apparatus 2430 and toward the left side 2506 of the patient transport apparatus 2430. It is contemplated that the controller 2502 may actuate the base wheel drives 2490*a*, 2490*b* to rotate the base wheel 2476*b* in the forward trajectory toward the footboard 2454 and rotate the other base wheel 2476*a* in a rearward trajectory toward the headboard 2452 such that the patient transport apparatus 2430 moves in a lateral direction that is perpendicular to the longitudinal axis L of the patient transport apparatus 2430 and toward the right side 2504 of the patient transport apparatus 2430.

Figure 24:
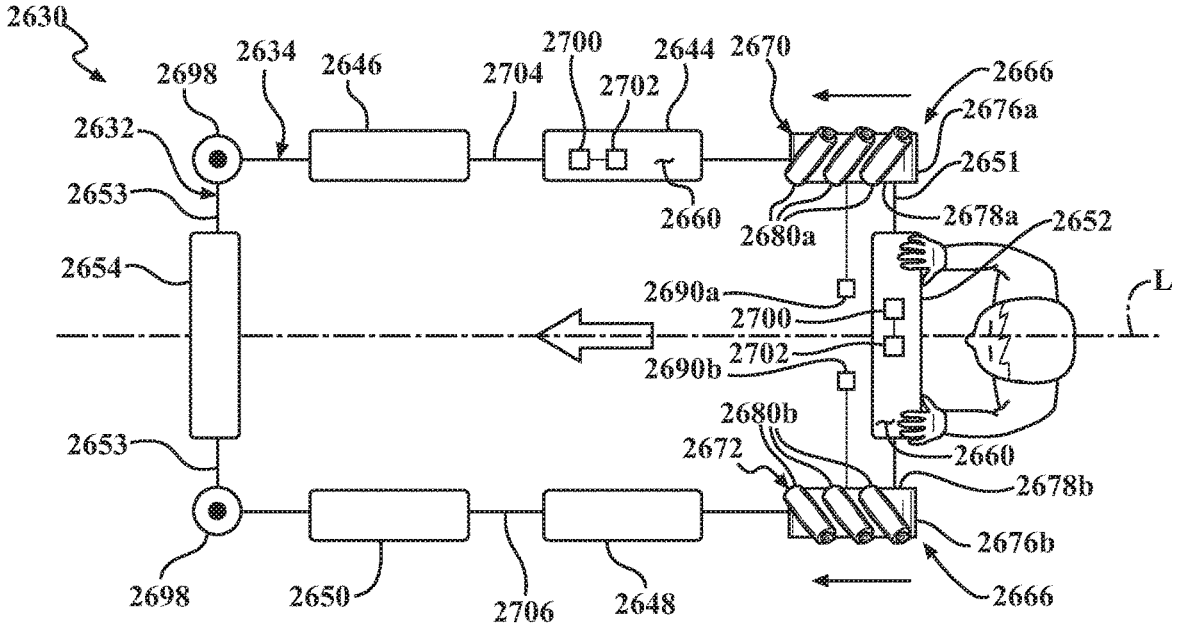
FIG. 24 is a schematic illustration of another embodiment of the patient transport apparatus of FIG. 23A having two mecanum wheels coupled to two corners adjacent to the headboard.

Referring to FIG. 24, another embodiment of a patient transport apparatus 2630 is similar to the patient transport apparatus 2430 of FIGS. 23A-23C, and it comprises similar components identified by the same reference numbers increased by 200. However, while the patient transport apparatus 2430 of FIGS. 23A-23C comprises two mecanum wheels 2470, 2472 coupled to opposing sides 2504, 2506, the patient transport apparatus 2630 comprises two mecanum wheels 2670, 2672 coupled to the corners 2666 adjacent to the headboard 2652. The mecanum wheels 2670, 2672 may include left and right handed peripheral wheels 2680*a*, 2680*b* positioned about the outer peripheries 2678*a*, 2678*b* to freely rotate about peripheral rotational axes.

Figure 25:
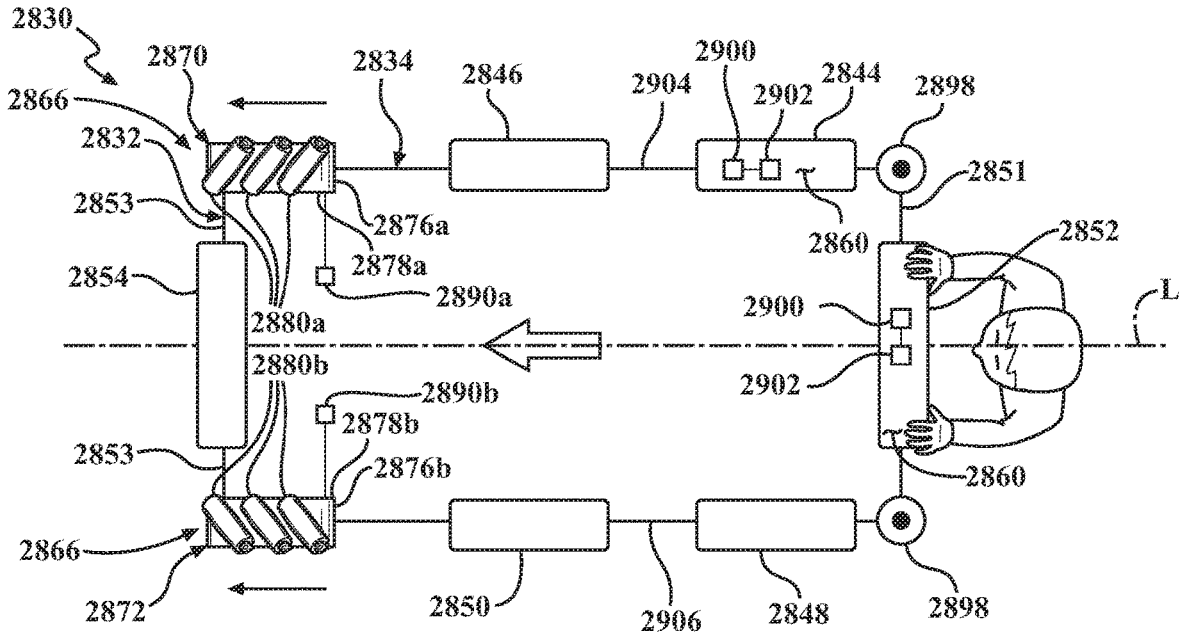
FIG. 25 is a schematic illustration of yet another embodiment of the patient transport apparatus of FIG. 23A having two mecanum wheels coupled to two corners adjacent to the footboard.

Referring to FIG. 25, yet another embodiment of a patient transport apparatus 2830 is similar to the patient transport apparatus 2430 of FIGS. 23A-23C, and it comprises similar components identified by the same reference numbers increased by 400. However, while the patient transport apparatus 2430 of FIGS. 23A-23C comprises two mecanum wheels 2470, 2472 coupled to opposing sides 2504, 2506, the patient transport apparatus 2830 of FIG. 25 comprises two mecanum wheels 2870, 2872 coupled to the corners 2866 adjacent to the footboard 2854. The mecanum wheels 2870, 2872 may include left and right handed peripheral wheels 2880*a*, 2880*b* positioned about the outer peripheries 2878*a*, 2878*b* to freely rotate about peripheral rotational axes.

Figure 26:
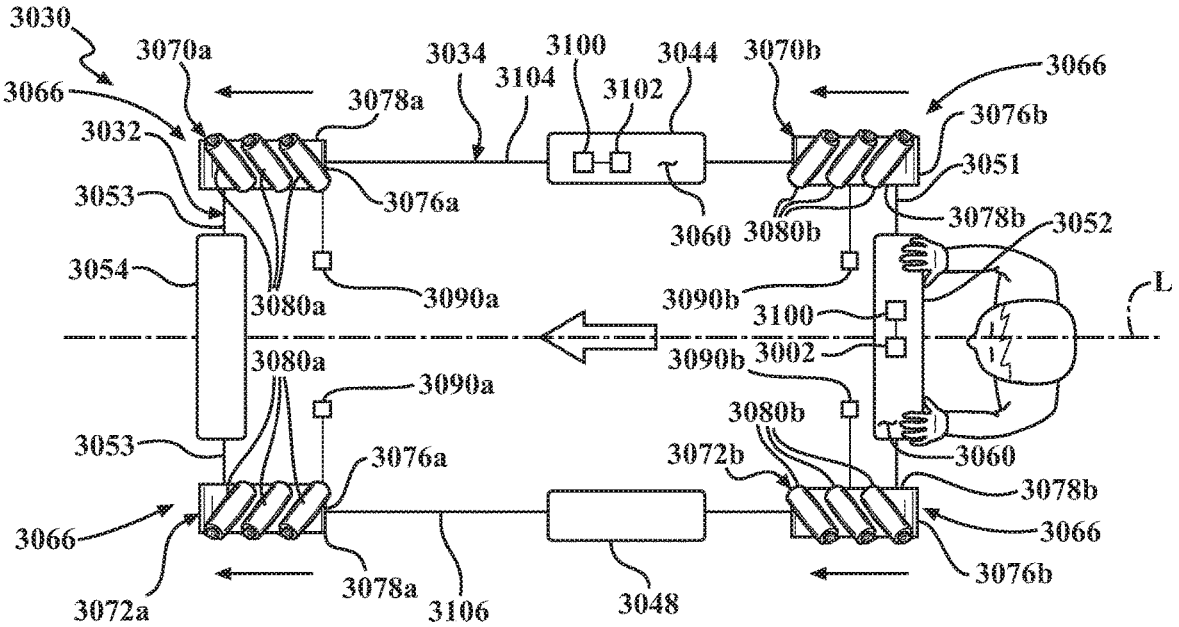
FIG. 26 is a schematic illustration of still another embodiment of a patient transport apparatus having four mecanum wheels coupled to the four corners of the patient transport apparatus.

Referring to FIG. 26, still another embodiment of a patient transport apparatus 3030 is similar to the patient transport apparatus 2630 of FIG. 24, and it comprises similar components identified by the same reference numbers increased by 400. However, while the patient transport apparatus 2630 of FIG. 24 comprises two support wheels 2698 coupled to the corners 2866 adjacent to the footboard 2854, the patient transport apparatus 3030 comprises two mecanum wheels 3070*a*, 3072*a* coupled to the corners 3066 adjacent to the footboard 3054. Furthermore, while the mecanum wheels 3070*b*, 3072*b* coupled to the corners 3066 adjacent to the headboard 3052 comprise a respective one of right and left handed peripheral wheels 3080*b*, the mecanum wheels 3070*a*, 3072*a* coupled to the corners 3066 adjacent to the footboard 3054 comprise an opposite configuration with a respective one of left and right handed peripheral wheels 3080*a*, in such a way that each peripheral wheel of the four mecanum wheels 3070*a*, 3072*a*, 3070*b*, 3072*b* applies force at generally right angles relative to corresponding wheelbase diagonals (not shown). This wheel configuration can improve the stability of the patient transport apparatus 3030 and improve its maneuverability in any direction at any speed and direction of rotation for each wheel 3070*a*, 3072*a*, 3070*b*, 3072*b*. Other mecanum wheel configurations including other configurations of the peripheral wheels are contemplated.

Figure 27:
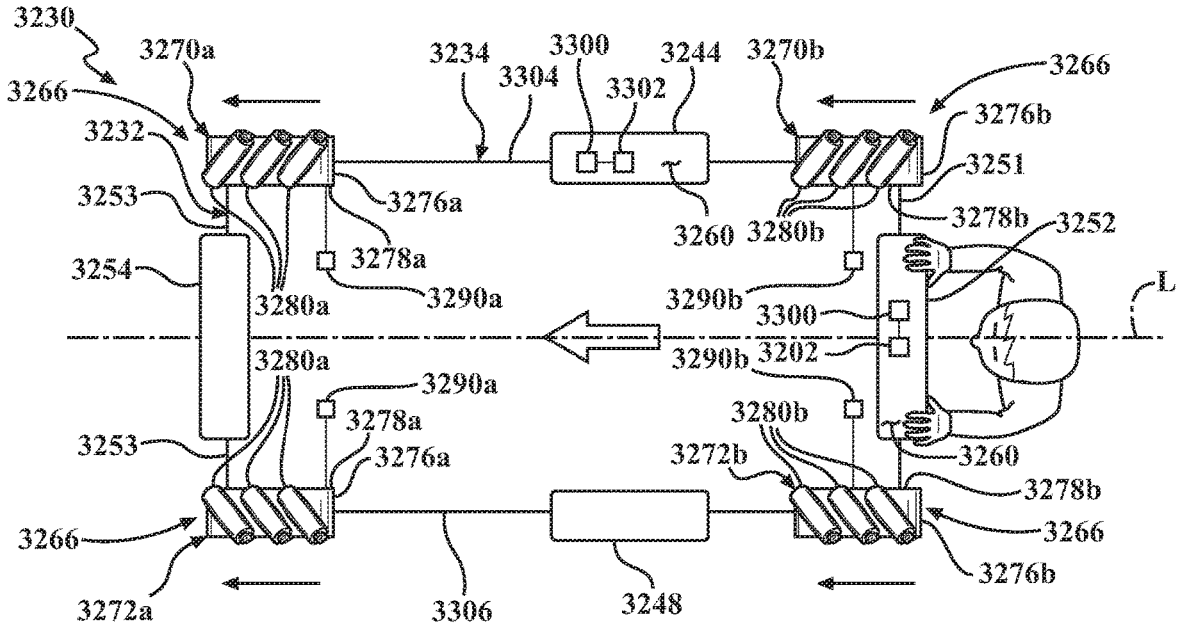
FIG. 27 is a schematic illustration of yet another embodiment of a patient transport apparatus having four mecanum wheels coupled to the four corners of the patient transport apparatus.

Other embodiments of the mecanum wheels and/or omni-directional wheels coupled to any portion of the patient transport apparatus in any suitable arrangement are contemplated. As but one example, FIG. 27 illustrates one embodiment of a patient transport apparatus 3230 that is similar to the patient transport apparatus 3030 of FIG. 26, and it comprises similar components identified by the same reference numbers increased by 200, except that the peripheral wheels 3280*a*, 3280*b* on the right side are oriented in the same direction and the peripheral wheels 3280*a*, 3280*b* on the left side are oriented in the same direction, yet opposite to those on the right side.

Figure 28:
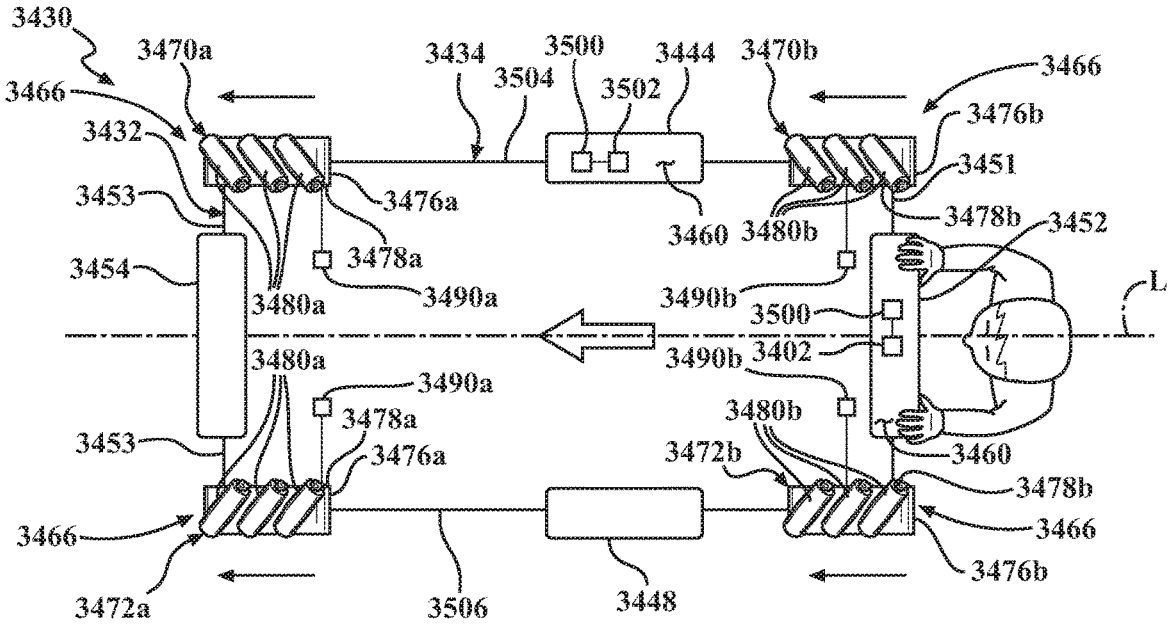
FIG. 28 is a schematic illustration of still another embodiment of a patient transport apparatus having four mecanum wheels coupled to the four corners of the patient transport apparatus.

As a further example, FIG. 28 is a schematic illustration of still another embodiment of a patient transport apparatus 3430. The patient transport apparatus 3430 is similar to the patient transport apparatus 3230 of FIG. 27, and it comprises similar components identified by the same reference numbers increased by 200, except that the orientations of the peripheral wheels 3480*a*, 3480*b* are reversed compared to FIG. 27.

Figure 29:
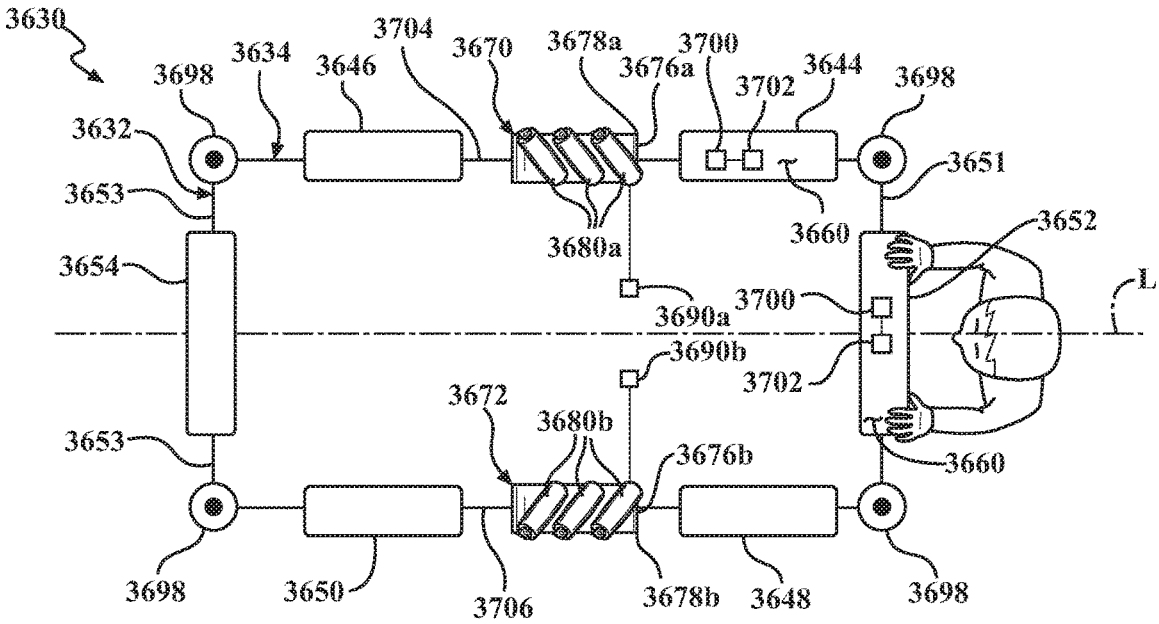
FIG. 29 is a schematic illustration of yet another embodiment of a patient transport apparatus having two mecanum wheels coupled to opposing sides of the patient transport apparatus.

As still another example, FIG. 29 is a schematic illustration of yet another embodiment of a patient transport apparatus 3630. The patient transport apparatus 3630 is similar to the patient transport apparatus 2430 of FIG. 23A, and it comprises similar components identified by the same reference numbers increased by 1200. The patient transport apparatus 3630 of FIG. 29 comprises two mecanum wheels 3670, 3672 coupled to opposing sides 3704, 3706 of the patient transport apparatus 3630 and having peripheral wheels 3680*a*, 3680*b* positioned in a reverse orientation relative to those shown in FIG. 23A.

Figure 30:
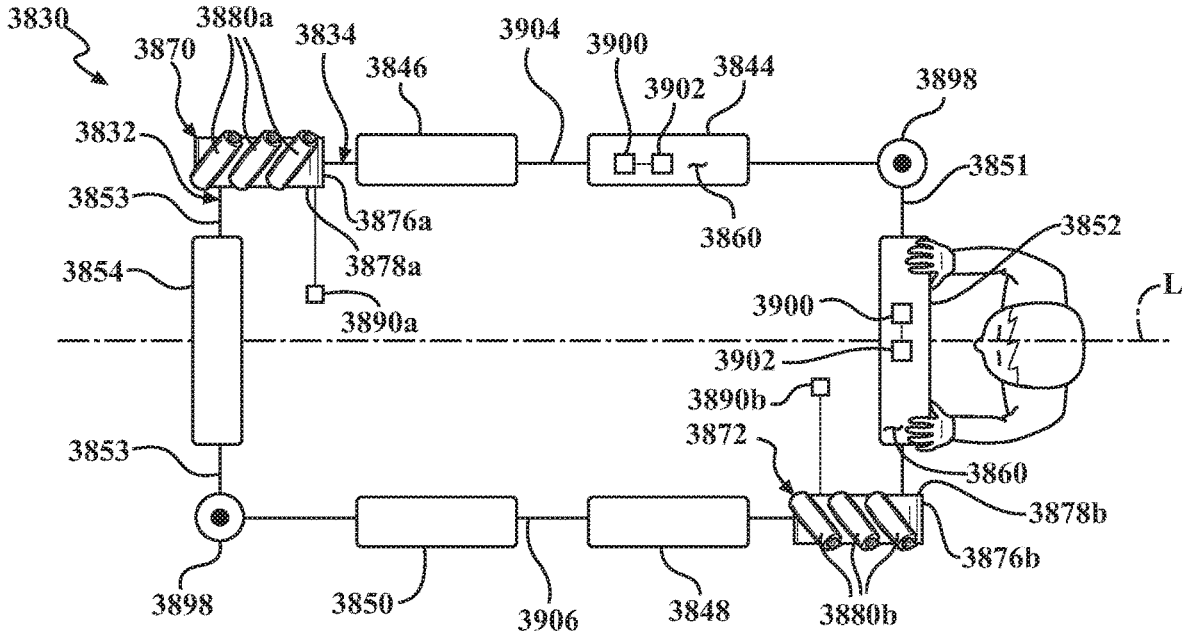
FIG. 30 is a schematic illustration of still another embodiment of a patient transport apparatus having two mecanum wheels coupled to two diametrically opposite corners of the patient transport apparatus and two support wheels coupled to the other two diametrically opposite corners of the patient transport apparatus.

FIG. 30 is a schematic illustration of still another embodiment of a patient transport apparatus 3830. The patient transport apparatus 3830 is similar to the patient transport apparatus 2430 of FIG. 23A, and it comprises similar components identified by the same reference numbers increased by 1400. While the patient transport apparatus 2430 of FIG. 23A comprises two mecanum wheels 2470, 2472 coupled to opposing left and right sides 2472, 2470 of the patient transport apparatus 2430, the patient transport apparatus 3830 of FIG. 30 comprises two mecanum wheels 3870, 3872 coupled to two diametrically opposite corners 3866 of the patient transport apparatus 3830.

Figure 31:
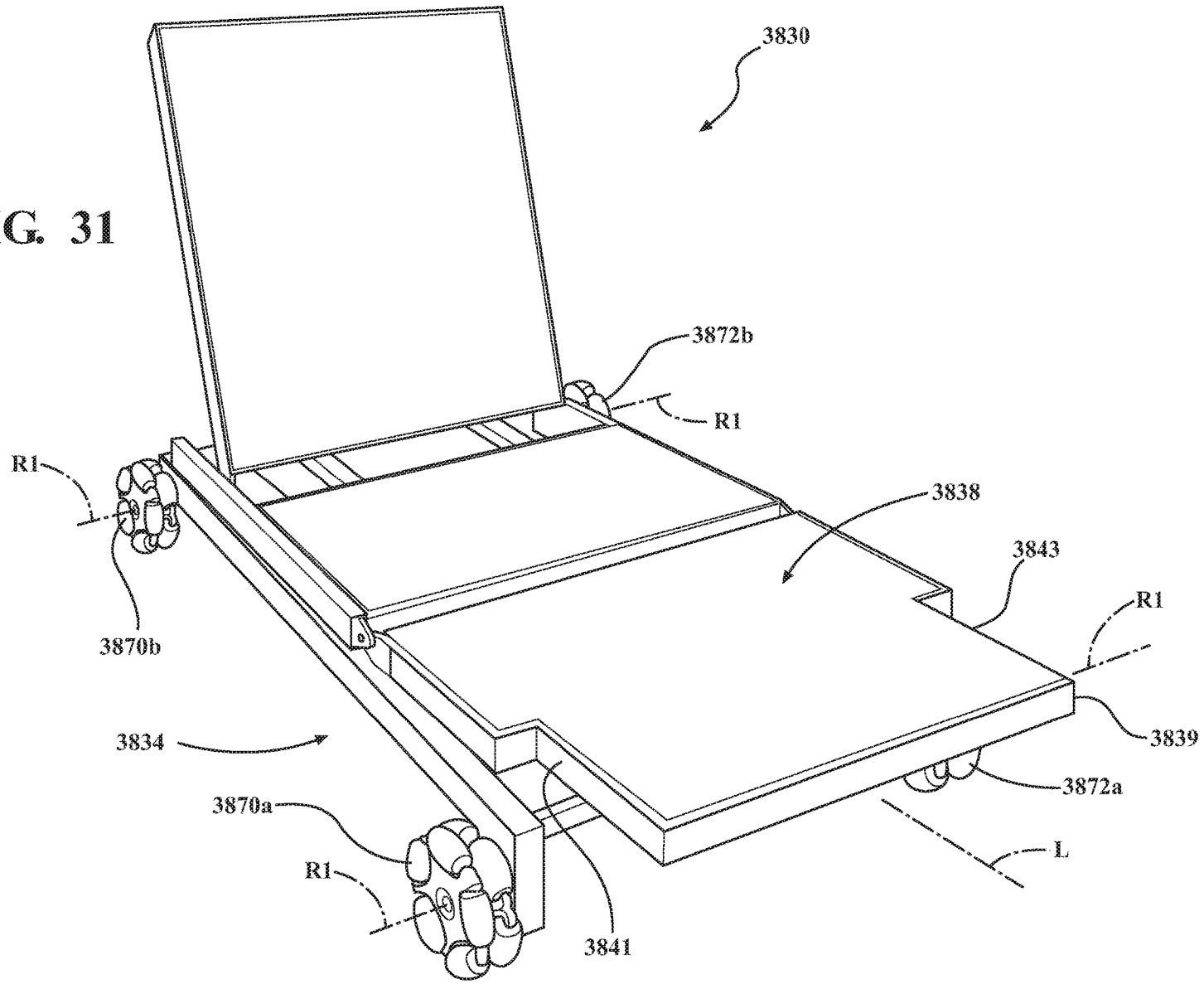
FIG. 31 is a perspective view of another embodiment of a patient transport apparatus having four corners and four omni-directional wheels positioned at its four corners, with the mattress, side rails, headboard, and footboard removed to illustrate that the patient support deck comprises the foot section with a pair of cutouts configured to provide clearance for the pair of non-swiveling omni-directional wheels.

Referring to FIG. 31, another embodiment of a patient transport apparatus 3830 is shown and it comprises similar components as FIGS. 7A and 7B. However, the patient transport apparatus 3830 of FIG. 31 has four omni-directional wheels 3870*a*, 3872*a*, 3870*b*, 3872*b* rotatably coupled to the four corners of the patient transport apparatus 3830 about four base rotational axes R1 that are perpendicular to the longitudinal axis L of the patient transport apparatus 3830. Furthermore, the patient transport apparatus 3830 comprises a patient support deck 3838 including a foot section 3839 with cutouts 3841, 3843 for providing clearance for the base 3834 when the foot section 3839 pivots toward the floor surface from its position shown in FIG. 31. Because these omni-directional wheels 3870*a*, 3872*a* do not swivel, the cutouts 3841, 3843 are sized to accommodate the base 3834, but do not need to be sized larger to accommodate sweeping paths associated with swiveling wheels.

Other configurations of mecanum wheels, omni-directional wheels, support wheels, and combinations thereof, are contemplated. In certain embodiments, all of the omni-directional wheels employed on the patient transport apparatus are configured to be actively driven, only a portion are configured to be actively driven, or all are zero velocity wheels that freely rotate and are not driven by a motor. Additionally, in some embodiment employing mecanum wheels, all of the mecanum wheels are configured to be actively driven, only a portion are configured to be actively driven, or all are zero velocity wheels that freely rotate and are not driven by a motor. Still other configurations can employ any combination of mecanum wheels, omni-directional wheels, and/or support wheels.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient transport apparatus comprising:

a support structure comprising a patient support surface, said patient support surface supported by a base having four corner portions with swivel wheels coupled thereto, said swivel wheels configured to swivel about swivel axes and to support said base on a floor surface;

a drive assembly attached to said base and positioned inward from said corner portions of said base, said drive assembly configured to facilitate omni-directional movement of said patient transport apparatus along the floor surface and comprising:

a first wheel assembly comprising a first base wheel rotatably coupled to said support structure about a first base rotational axis, said first base wheel having a first outer periphery, said first wheel assembly comprising a first plurality of peripheral wheels disposed about said first outer periphery to rotate about a first plurality of peripheral rotational axes, and said first wheel assembly comprising a first motion control device configured to selectively control rotation of one of said first plurality of peripheral wheels independent of rotation of said first base wheel about said first base rotational axis;

a second wheel assembly having a second base wheel rotatably coupled to said support structure about a second base rotational axis and having a second outer periphery, said second wheel assembly comprising a second plurality of peripheral wheels disposed about said second outer periphery to rotate about a second plurality of peripheral rotational axes, and said second wheel assembly comprising a second motion control device configured to selectively control rotation of one of said second plurality of peripheral wheels independent of rotation of said second base wheel about said second base rotational axis;

a third wheel assembly having a third base wheel rotatably coupled to said support structure about a third base rotational axis and having a third outer periphery, said third wheel assembly comprising a third plurality of peripheral wheels disposed about said third outer periphery to rotate about a third plurality of peripheral rotational axes, and said third wheel assembly comprising a third motion control device configured to selectively control rotation of one of said third plurality of peripheral wheels independent of rotation of said third base wheel about said third base rotational axis; and a controller and first, second, and third base wheel drives coupled to said base wheels and configured to be actuated by said controller to control rotation of said base wheels;

wherein said support structure has a longitudinal axis and head and foot end portions along said longitudinal axis, and said first and second base wheels are rotatably coupled to said support structure about said first and second base rotational axes that are transverse to said longitudinal axis by a common acute angle, and wherein said third base wheel is arranged on said support structure such that said third base rotational axis is perpendicular to said longitudinal axis.

2. The patient transport apparatus of claim 1, wherein said first motion control device comprises at least one of a motor and a brake.

3. The patient transport apparatus of claim 2, wherein said first motion control device comprises a control wheel coupled to said motor.

4. The patient transport apparatus of claim 3, wherein said control wheel is configured to engage said one of said first peripheral wheels.

5. The patient transport apparatus of claim 2, wherein said brake comprises a drum brake for selectively impeding rotation of said one of said first peripheral wheels.

6. The patient transport apparatus of claim 1, wherein said motion control device comprises a gear associated with said one of said first peripheral wheels.

7. The patient transport apparatus of claim 1, further comprising an operator input device coupled to said controller and configured to generate an input signal, said controller being further configured to actuate said first motion control device based on said input signal received from said operator input device.

8. The patient transport apparatus of claim 1, wherein said controller is configured to actuate said first and second base wheel drives to rotate said base wheels and actuate said motion control devices to inhibit rotation of said peripheral wheels such that said patient transport apparatus moves in a forward direction that is parallel with said longitudinal axis of said patient transport apparatus.

9. The patient transport apparatus of claim 1, wherein said controller is configured to actuate said motion control devices to actively rotate said peripheral wheels such that said patient transport apparatus moves in a lateral direction that is perpendicular to said longitudinal axis of said patient transport apparatus.

10. The patient transport apparatus of claim 1, wherein said first and second base wheels are arranged on said support structure such that said first and second base rotational axes converge toward said foot end portion of said support structure.

11. The patient transport apparatus of claim 10, wherein said controller is configured to actuate said first and second base wheel drives to rotate said base wheels such that said patient transport apparatus moves in a longitudinal direction that is parallel with said longitudinal axis of said patient transport apparatus.

12. The patient transport apparatus of claim 11, wherein said controller is configured to actuate said first and second base wheel drives to counter-rotate said first and second base wheels such that said patient transport apparatus moves in a lateral direction that is perpendicular to said longitudinal axis of said patient transport apparatus.

13. The patient transport apparatus of claim 12, wherein said controller is configured to actuate said base wheel drives to rotate one of said base wheels and inhibit rotation of another of said base wheels such that said patient transport apparatus moves in a direction that is transverse to a longitudinal axis of said support structure.

14. The patient transport apparatus of claim 1, wherein said first and second base wheels are arranged on said support structure such that said first and second base rotational axes converge toward said head end portion of said support structure.

15. The patient transport apparatus of claim 1, wherein said first wheel assembly comprises a housing defining an internal cavity with said first motion control device being disposed within said internal cavity.

16. The patient transport apparatus of claim 1, wherein said swivel wheels are further defined as caster wheels.

17. A patient transport apparatus comprising:

a support structure comprising a patient support surface and defining a longitudinal axis and head and foot end portions along said longitudinal axis, said patient support surface supported by a base having four corner portions with swivel wheels coupled thereto, said swivel wheels configured to swivel about swivel axes and to support said base on a floor surface; and a drive assembly operatively attached to said base inward from said corner portions of said base, said drive assembly configured to facilitate omni-directional movement of said patient transport apparatus along the floor surface, and comprising first, second, and third wheel assemblies each comprising:

a respective base wheel having a respective outer periphery and being rotatably coupled to said support structure about a respective base rotational axis, a respective plurality of peripheral wheels disposed about said respective outer periphery to rotate about a respective plurality of peripheral rotational axes, and a respective motion control device configured to selectively control rotation of one of said respective peripheral wheels independent of rotation of said respective base wheel about said respective base rotational axis;

wherein said respective base rotational axes of said first and second wheel assemblies are arranged transverse to, but not parallel to, said longitudinal axis, and wherein said base rotational axis of said third wheel assembly is arranged perpendicular to said longitudinal axis.

18. The patient transport apparatus as set forth in claim 17, wherein said first, second, and third wheel assemblies each further comprise a respective base wheel drive coupled to said respective base wheel to control rotation of said respective base wheel.

19. The patient transport apparatus as set forth in claim 18, further comprising a controller coupled to said base wheels drives of each of said first, second, and third wheel assemblies to control rotation of said respective base wheels.

20. The patient transport apparatus as set forth in claim 17, wherein said respective base rotational axes of said first and second wheel assemblies are arranged transverse to said longitudinal axis at a common angle.

21. A patient transport apparatus comprising:

a support structure comprising a patient support surface and defining a longitudinal axis and head and foot end portions along said longitudinal axis, said patient support surface supported by a base having four corner portions with swivel wheels coupled thereto, said swivel wheels configured to swivel about swivel axes and to support said base on a floor surface; and a drive assembly operatively attached to said base inward from said corner portions of said base, said drive assembly configured to facilitate omni-directional movement of said patient transport apparatus along said floor surface, and comprising first, second, and third wheel assemblies each comprising:

a respective base wheel having a respective outer periphery and being rotatably coupled to said support structure about a respective base rotational axis, a respective plurality of peripheral wheels disposed about said respective outer periphery to rotate about a respective plurality of peripheral rotational axes, and a respective motion control device configured to selectively control rotation of one of said respective peripheral wheels independent of rotation of said respective base wheel about said respective base rotational axis;

wherein said respective base rotational axes of said first and second wheel assemblies are arranged transverse to said longitudinal axis at a common acute angle; and wherein said base rotational axis of said third wheel assembly is arranged transverse to said longitudinal axis at an angle that is different from said common angle.

22. The patient transport apparatus as set forth in claim 21, wherein said first, second, and third wheel assemblies each further comprise a respective base wheel drive coupled to said respective base wheel to control rotation of said respective base wheel.

23. The patient transport apparatus as set forth in claim 22, further comprising a controller coupled to said base wheels drives of each of said first, second, and third wheel assemblies to control rotation of said respective base wheels.

* * * * *